US008457543B2

(12) United States Patent
Nagasako et al.

(10) Patent No.: US 8,457,543 B2
(45) Date of Patent: Jun. 4, 2013

(54) IMAGE FORMING APPARATUS

(75) Inventors: Shuuya Nagasako, Ebina (JP); Junichi Iida, Kawasaki (JP); Shinya Kitaoka, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 299 days.

(21) Appl. No.: 12/585,344

(22) Filed: Sep. 11, 2009

(65) Prior Publication Data

US 2010/0119274 A1 May 13, 2010

(30) Foreign Application Priority Data

Sep. 16, 2008 (JP) ..... 2008-236027

(51) Int. Cl.
*G03G 21/00* (2006.01)

(52) U.S. Cl.
USPC ..... 399/405; 400/692

(58) Field of Classification Search
USPC ..... 399/405, 407, 410, 408
See application file for complete search history.

(56) References Cited

U.S. PATENT DOCUMENTS

| | | | | |
|---|---|---|---|---|
| 6,783,124 | B2 | 8/2004 | Tamura et al. | |
| 7,014,183 | B2 | 3/2006 | Tamura et al. | |
| 2003/0006543 | A1 | 1/2003 | Tamura et al. | |
| 2003/0080487 | A1 | 5/2003 | Tamura et al. | |
| 2003/0215275 | A1 | 11/2003 | Tamura et al. | |
| 2004/0096254 | A1* | 5/2004 | Sato et al. | 399/405 |
| 2005/0074255 | A1* | 4/2005 | Awaya | 399/92 |
| 2005/0214028 | A1* | 9/2005 | Yasumoto | 399/124 |
| 2006/0182461 | A1* | 8/2006 | Imada et al. | 399/92 |
| 2007/0051219 | A1 | 3/2007 | Tamura et al. | |
| 2007/0235917 | A1 | 10/2007 | Nagasako et al. | |
| 2008/0236351 | A1 | 10/2008 | Hidaka et al. | |

FOREIGN PATENT DOCUMENTS

| | | | |
|---|---|---|---|
| JP | 10235968 | A * | 9/1998 |
| JP | 2000-118841 | | 4/2000 |
| JP | 2001-235916 | | 8/2001 |
| JP | 2002-196653 | | 7/2002 |
| JP | 2002258562 | A * | 9/2002 |
| JP | 2002-318477 | | 10/2002 |
| JP | 2002-333750 | | 11/2002 |
| JP | 2002-372817 | | 12/2002 |
| JP | 2004-155566 | | 6/2004 |
| JP | 2005-308911 | | 11/2005 |
| JP | 2005-324952 | | 11/2005 |

(Continued)

OTHER PUBLICATIONS

Abstract of JP 2002-338117 published on Nov. 27, 2002.

(Continued)

*Primary Examiner* — Matthew G Marini
*Assistant Examiner* — Ruben Parco, Jr.
(74) *Attorney, Agent, or Firm* — Harness, Dickey & Pierce

(57) ABSTRACT

An image forming apparatus includes an image forming unit to form an image on a sheet of recording media, an image reading unit to read image data of an original document, disposed above the image forming unit, a sheet discharge space defined by the image reading unit and the image forming unit and disposed therebetween, a discharge port formed in a first inner side wall of a main body of the image forming apparatus, through which the sheet is discharged into the sheet discharge space, a positioning member to position and detachably mount a positioning member to position and detachably mount an auxiliary unit adjacent to the discharge port in the sheet discharge space.

16 Claims, 19 Drawing Sheets

FOREIGN PATENT DOCUMENTS

| | | |
|---|---|---|
| JP | 2005-345541 | 12/2005 |
| JP | 3768900 | 2/2006 |
| JP | 3817433 | 6/2006 |
| JP | 2006-193283 | 7/2006 |
| JP | 2006-206197 | 8/2006 |
| JP | 2006-206271 | 8/2006 |
| JP | 2006-240761 | 9/2006 |
| JP | 2006-248684 | 9/2006 |
| JP | 2006-248686 | 9/2006 |
| JP | 2007-308211 | 11/2007 |

OTHER PUBLICATIONS

Abstract of JP 2002-278186 published on Sep. 27, 2002.

Office Action for corresponding Japanese Application No. 2008-236027 dated Dec. 18, 2012.

* cited by examiner

IMAGE FORMING APPARATUS

CROSS-REFERENCE TO RELATED APPLICATIONS

This patent specification is based on and claims priority from Japanese Patent Application No. 2008-236027, filed on Sep. 16, 2008 in the Japan Patent Office, which is hereby incorporated by reference herein in its entirety.

BACKGROUND OF THE INVENTION

1. Field of the Invention

The present invention generally relates to an image forming apparatus such as a copier, a printer, a facsimile machine, or a multifunction machine including at least two of those functions.

2. Discussion of the Background Art

Currently, image forming apparatuses, such as copiers, printers, facsimile machines, or multifunction machines including at least two of those functions, etc., often provide a sheet discharge space inside a housing thereof to make them compact. In such image forming apparatuses, which are called "housing-internal discharge type image forming apparatuses", sheets of recording media on which images are formed are not discharged onto a discharge tray projecting from a side of the image forming apparatuses but instead are discharged into the sheet discharge space disposed inside the housing where users can access the sheets externally. The housing-internal discharge space is typically disposed between a scanner and a main body of the image forming apparatus.

In addition, as an approach to make the image forming apparatuses compact, finishers that perform post-processing, for example, aligning, sorting, stapling, and/or punching the output sheets are disposed inside the housing-internal discharge space, in contrast to their conventional disposition on the side of the image forming apparatuses.

For example, one known image forming apparatus includes a movable discharge tray, a discharged-sheet detector, and a discharge tray lift that are disposed within the housing-internal discharge space disposed beneath the scanner. The discharged-sheet detector detects the position of the surface of the sheet discharged on the top on the movable discharge tray, that is, the level of the discharged sheets, and the discharge tray lift moves the movable discharge tray in a direction in which the sheets are stacked. A controller drives the discharge tray lift to adjust the height of the movable discharge tray suitably for the level of the discharged sheets detected by the discharged-sheet detector while maintaining a space between the scanner and the sheets discharged on the movable discharge tray so that the user can remove the sheets therefrom.

In another known image forming apparatus, sheets are discharged through a discharge port disposed on the inner side wall of the main body forming the housing-internal discharge space and are stacked on a first discharge tray integrally formed on an upper surface of the main body that forms a bottom of the housing-internal discharge space. A detachably attachable second tray or finisher such as a stapler can be provided above the discharge tray in the housing-internal discharge space. The discharge tray includes a horizontal portion formed on a downstream side in the direction in which the sheets are discharged (hereinafter "sheet discharge direction") and a sloped portion continuous with the horizontal portion. The sloped portion descends toward upstream and is lowest at the position under the discharge port. When the second tray or the finisher is mounted in the housing-internal discharge space, it is possible that the leading edge of the sheets discharged onto the sloped portion of the discharge tray may hit the lower surface of the second tray or the finisher and then curve. Therefore, this known image forming apparatus further includes an auxiliary tray detachably attachable to the sloped portion of the discharge tray to adjust the inclination of the sloped portion, thus preventing the sheets from hitting the lower surface of the second tray or the finisher.

Although finishers can be thus mounted in the housing-internal discharge space, if a sheet receiving port of the finisher, through which the sheet output from the image forming apparatus enter the finisher, is not aligned with the discharge port of the image forming apparatus, the apparatus can be jammed and the sheet is thus damaged.

In view of the foregoing, there is a need to position the finisher at a position adjacent to the discharge port of the image forming apparatus so that the sheet receiving port of the finisher is properly connected to the discharge port of the image forming apparatus with a simple mechanism.

SUMMARY OF THE INVENTION

In view of the foregoing, one illustrative embodiment of the present invention provides an image forming apparatus includes an image forming unit to form an image on a sheet of recording media, an image reading unit to read image data of an original document, disposed above the image forming unit, and a sheet discharge space defined by the image reading unit and the image forming unit, and disposed therebetween. A discharge port is formed in a first inner side wall of a main body of the image forming apparatus, and the sheet is discharged through the discharge port into the sheet discharge space. The image forming apparatus further includes a positioning member to position and detachably mount an auxiliary unit adjacent to the discharge port in the sheet discharge space. The auxiliary unit is one of a finisher and a relay unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 2:
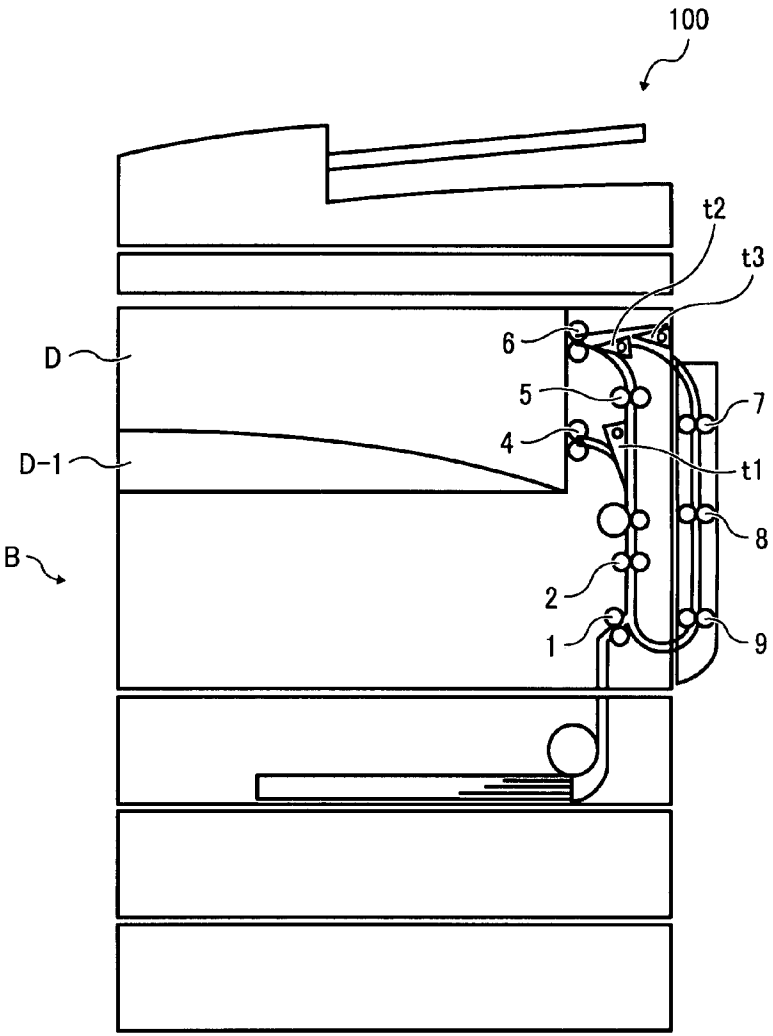
FIG. 2 schematically illustrates a sheet transport path in the image forming apparatus shown in FIG. 1.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 1:
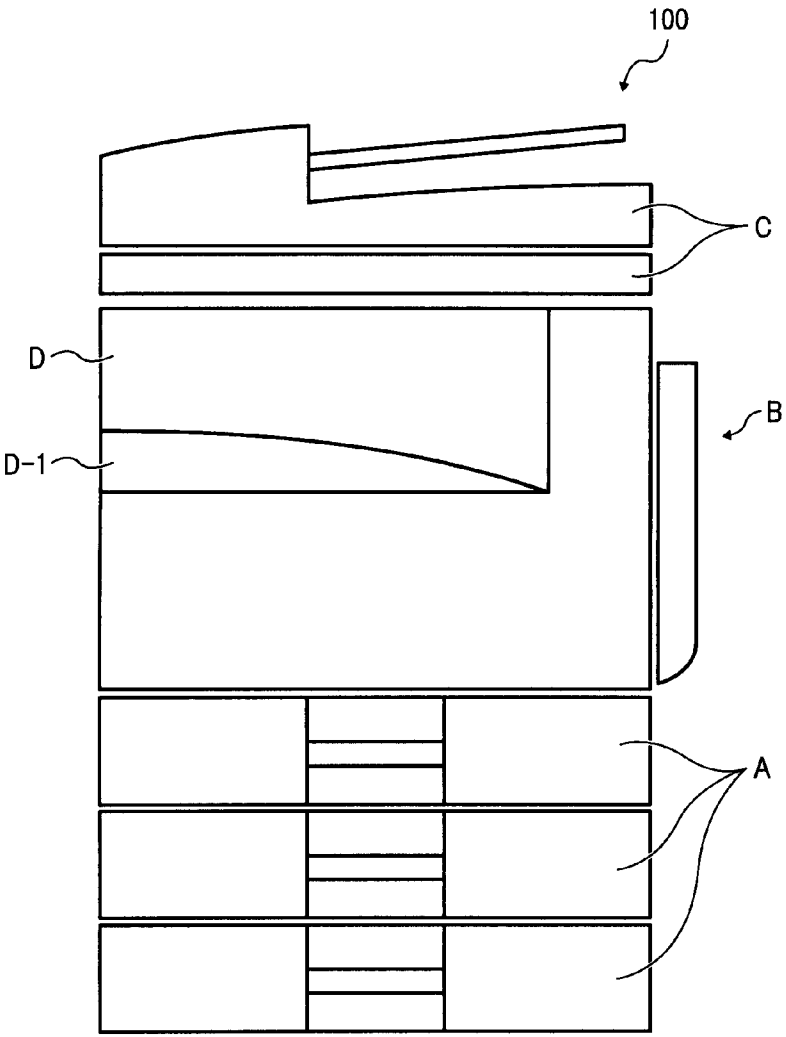
FIG. 1 is a front elevation view illustrating an exterior of an image forming apparatus according to an illustrative embodiment of the present invention.

Referring now to the drawings, wherein like reference numerals designate identical or corresponding parts throughout the several views thereof, and particularly to FIG. 1, an image forming apparatus according to an illustrative embodiment of the present invention is described.

In the present embodiment, the image forming apparatus can read image data of original documents and output sheets of recording media on which image are formed. In addition, a finisher that perform post-processing, for example, aligning, sorting, stapling, and/or punching the output sheets as well as additional discharge trays are detachably attachable to the image forming apparatus.

A configuration and operation of the image forming apparatus according to the present embodiment are described below with reference to FIG. 1 that is a front elevation view illustrating an exterior of the image forming apparatus.

Figure 9:
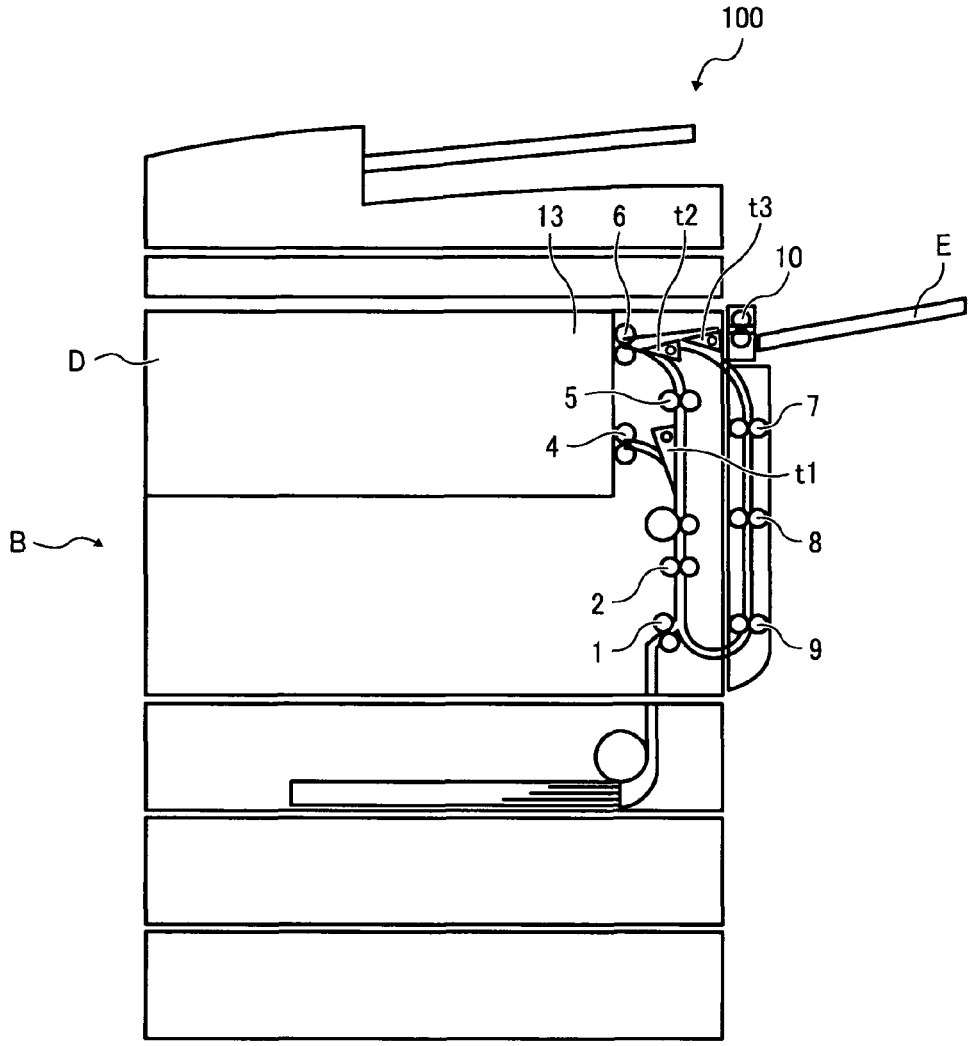
FIG. 9 illustrates the image forming apparatus from which the stack member is removed and to which the side discharge unit is attached.

Referring to FIG. 1, an image forming apparatus 100 includes a sheet feeder A disposed beneath an image forming unit or main body B that forms images on sheets of recording media such as paper, overhead projector (OHP) film, and the like, and an image reading unit C to read image data of original documents, disposed above the image forming unit B. The sheet feeder A includes multiple sheet cassettes each of which contains the sheets to be fed to the image forming unit B. The image forming apparatus 100 further includes a housing-internal discharge space D provided beneath the image reading unit C to store the sheets discharged from the image forming unit B after images are formed thereon. A stack member D-1 is mounted in the discharge space D. The stack member D-1 is detachable from the discharge space D as shown in FIG. 9.

FIG. 2 schematically illustrates a sheet transport path in the image forming apparatus 100.

Referring to FIG. 2, the image forming unit B includes transport roller pairs of 1, 2, 5, 7, 8, and 9 disposed along the sheet transport path, a pair of discharge rollers 4 to discharge the sheets onto the stack member D-1, a pair of reverse rollers 6 to transport the sheets in reverse so that images are formed on both sides of the sheets, and switching members t1 through t3 to switch the sheet transport path. The switching member t1 switches the sheet transport path between a discharge path leading to the discharge rollers 4 and a transport path leading to the reverse rollers 6.

In the present embodiment, the image forming apparatus 100 employs a known electrophotographic image forming method, and the image forming unit B further includes an image forming mechanism to form images electrostatically on an image carrier such as a photoconductor drum, a transfer unit to transfer the image from the image carrier onto the sheet, and a fixing unit to fix the image thereon although they are not shown in the drawings.

Figure 3B:
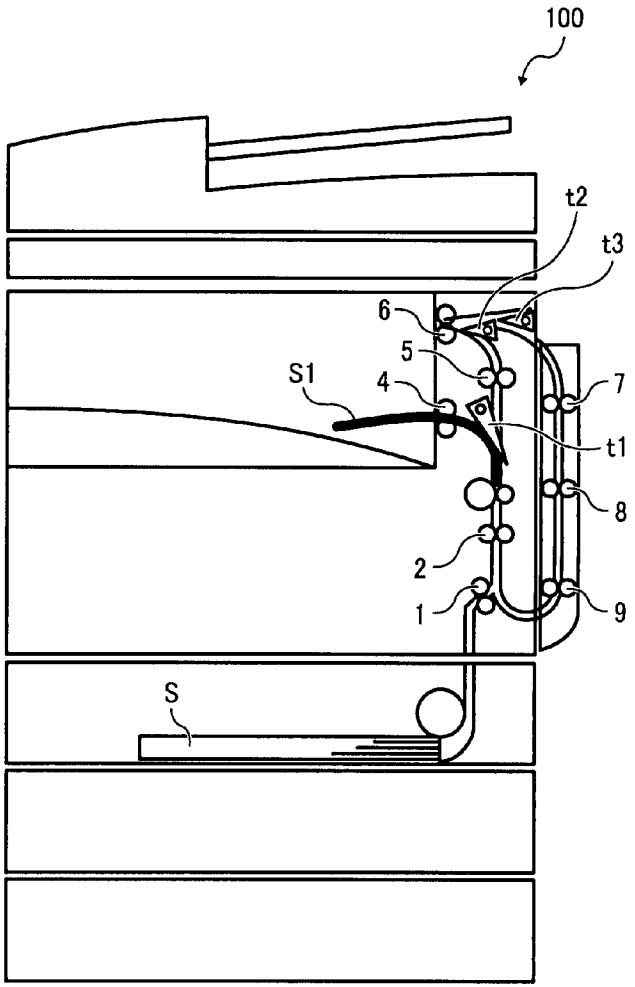
FIGS. 3A and 3B illustrate sheet transport in the image forming processes shown in FIG. 2 operating in a single-side printing mode.
Figure 3A:
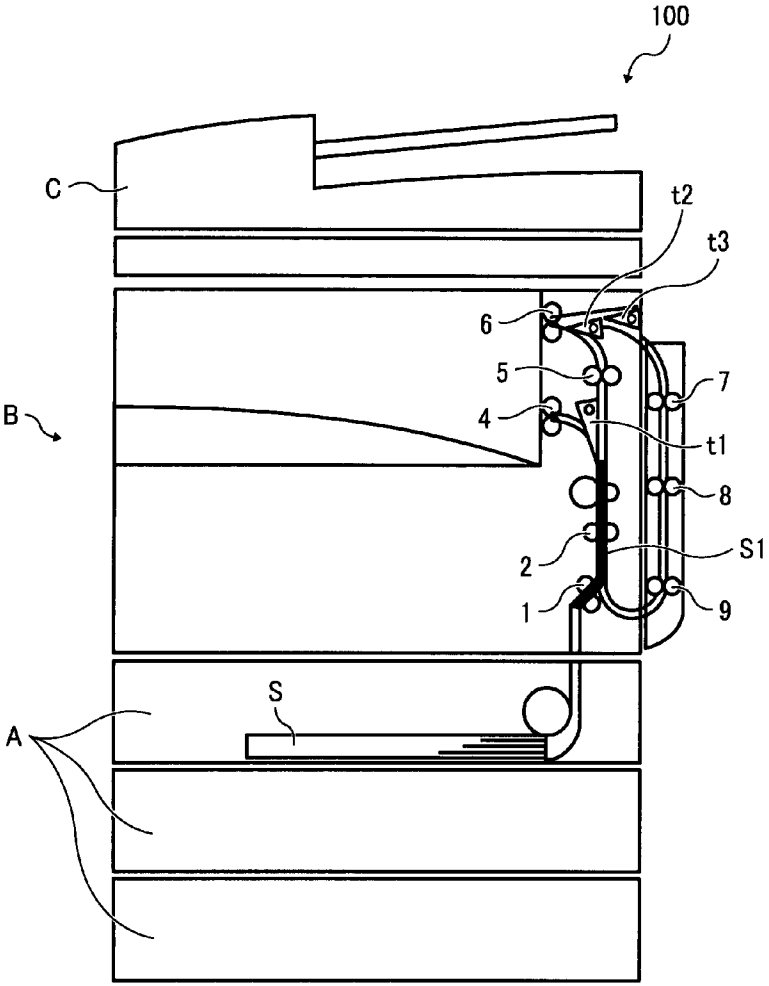

Next, image forming processes of the image forming apparatus 100 are describe below with reference to FIGS. 3A and 3B that illustrate positions of the sheets in the respective image forming processes.

In a single-side printing mode, in which images are formed on only a first side or front side of the sheets, initially the image forming apparatus 100 acquires image data from an external device such as a computer or the image reading unit C. Then, a sheet S1 is separated from a bundle of sheets S contained in the sheet feeder A and then transported to the image forming unit B through the sheet transport path as shown in FIG. 3A. The sheet S1 is transported by the transport roller pairs 1 and 2. The image forming mechanism, not shown, in the image forming unit B forms an image on the image carrier according to the image date, and then the image is transferred from the image carrier onto the first side of the sheet S1. Subsequently, as shown in FIG. 3B, the switching member t1 switches the sheet transport path to the discharge path, and then the discharge rollers 4 discharges the sheet S1 onto the stack member D1.

Next, a duplex printing mode, in which images are formed on both sides of the sheets, is described below with reference to FIGS. 4A through 4D that illustrate positions of the sheets in the duplex printing mode.

Figure 4B:
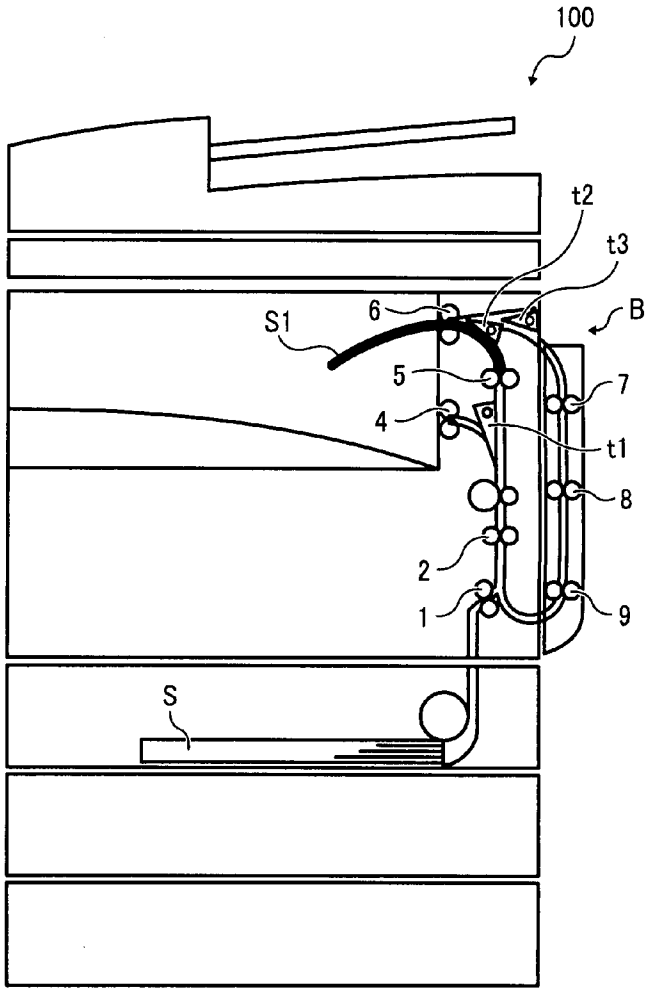
FIGS. 4A through 4E illustrate sheet transport in the image forming apparatus shown in FIG. 2 operating in a duplex printing mode.
Figure 4A:
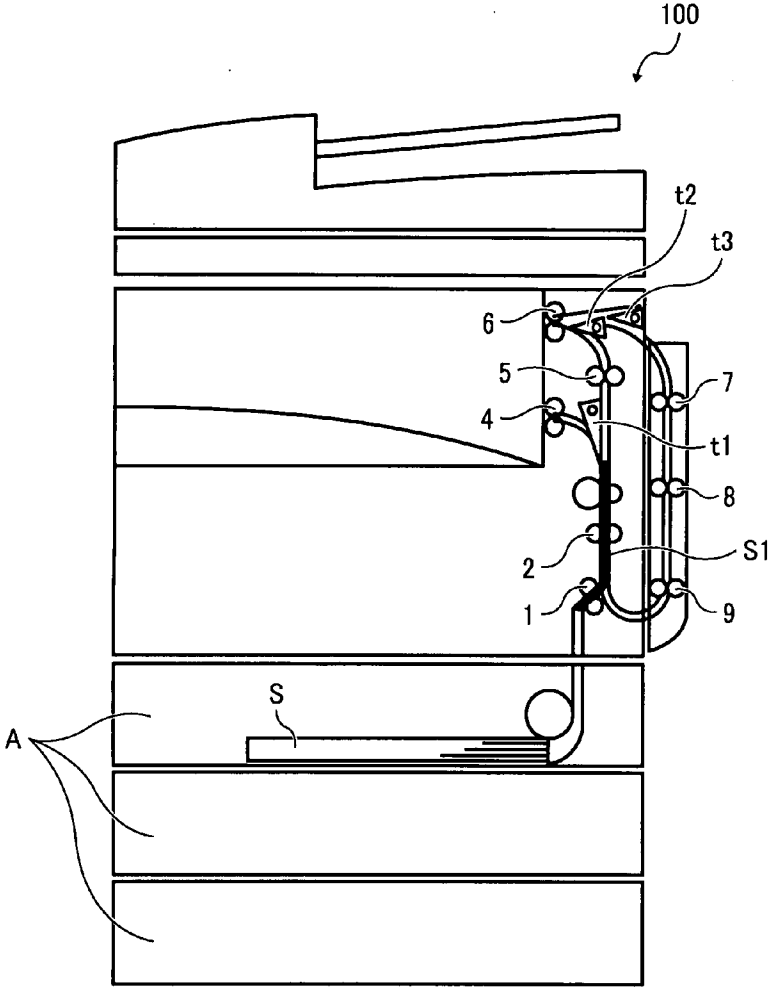
Figure 4D:
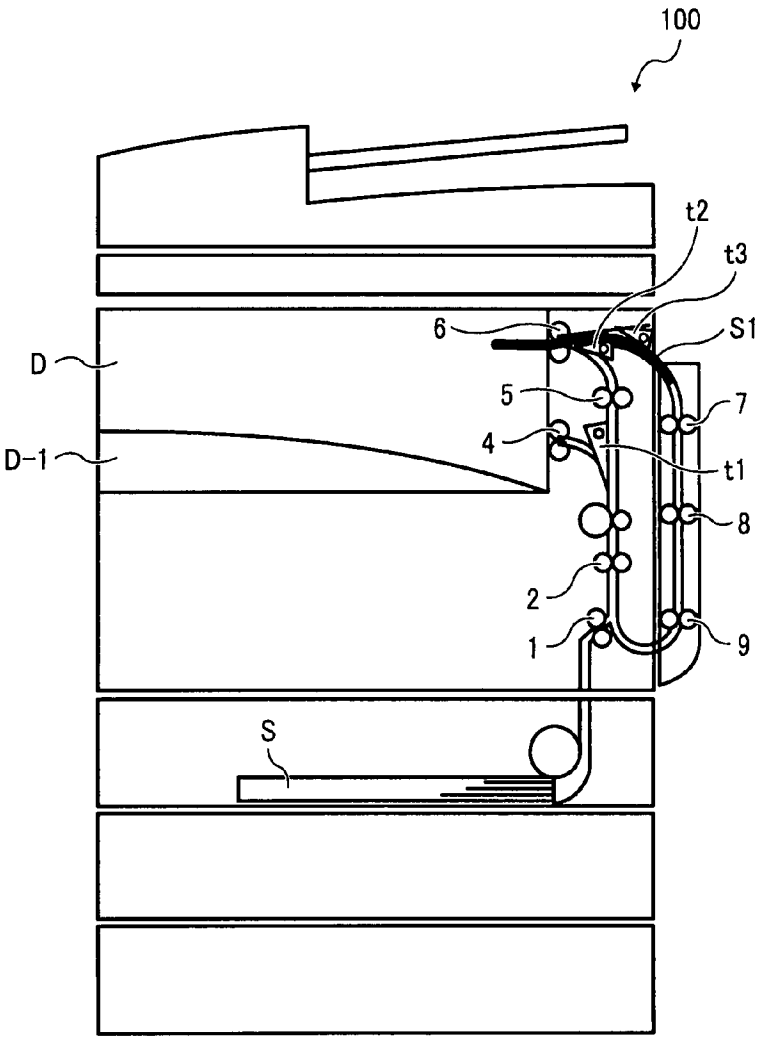
Figure 4C:
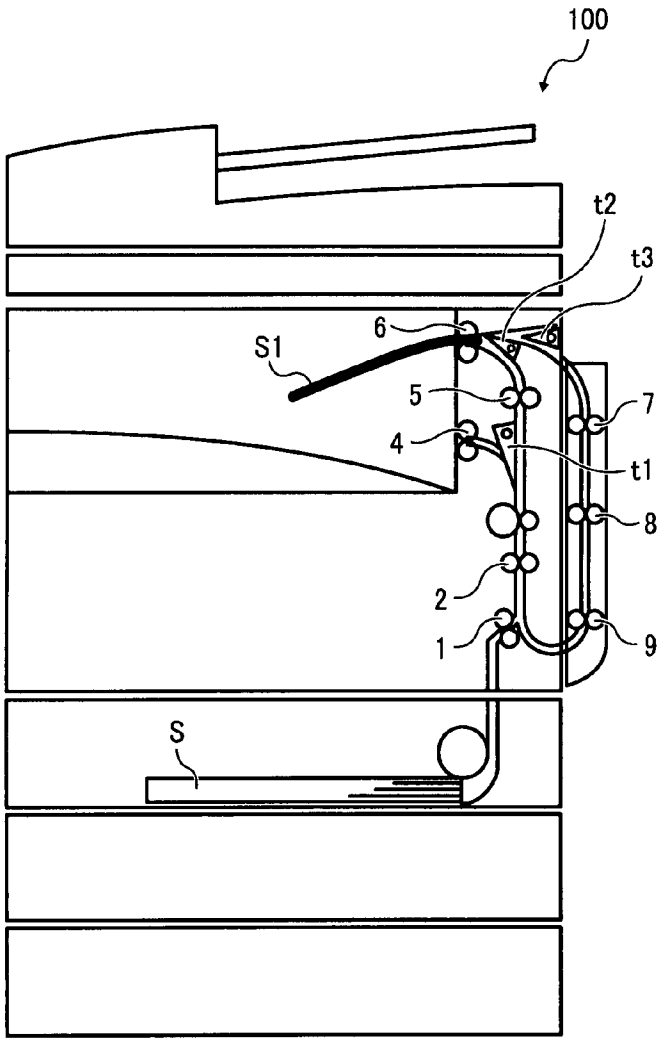

Similarly to the single-side printing mode, the sheet S1 fed from the sheet feeder A is initially transported by the transport roller pairs 1 and 2, and an image is formed on the first side of the sheet S1 as shown in FIG. 4A. Then, the switching member t1 switches the sheet transport path to the transport path leading to the reverse rollers 6, and the sheet S1 is transported by the transport roller pair 5. The reverse rollers 6 keeps rotating in a normal direction, transporting the sheet S1 in a direction in which the sheet S1 is discharged (hereinafter "sheet discharge direction") until a certain portion of the sheet S1 is exposed from the main body B as shown in FIG. 4B. After the trailing edge of the sheet S1 passes the switching member t2, the switching member t2 switches the sheet transport path to a reverse path formed by a right side path and a vertical reverse path. Then, the reverse rollers 6 rotate in reverse, thereby forwarding the sheet 51 to the right side path as shown in FIGS. 4C and 4D.

Figure 4E:
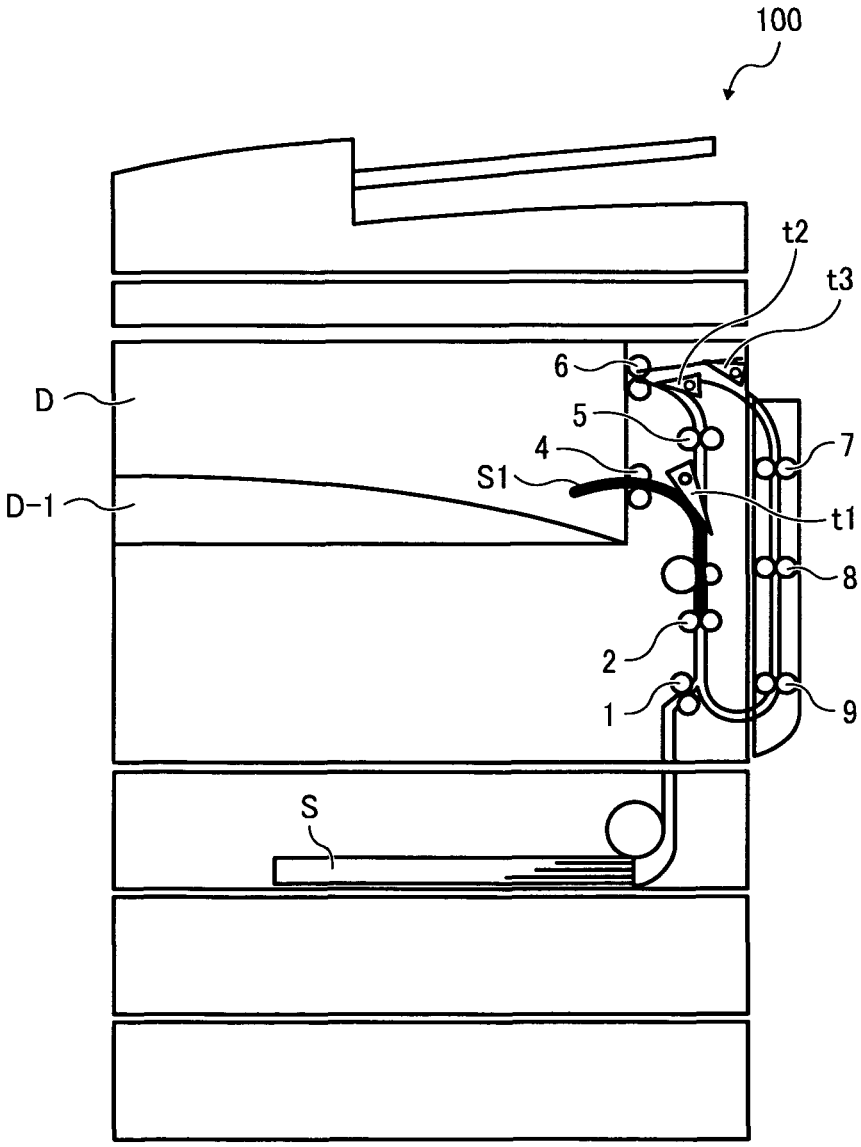

Subsequently, the switching member t3 guides the sheet S1 to the vertical reverse path disposed on the right in FIGS. 4A through 4D. The transport roller pairs 7, 8, and 9 transport the sheet S1 downward, and the sheet S1 thus reversed is again transported to the transport roller pair 2. Then, an image is formed on a second side or back side of the sheet S1, which after the switching member t1 guides the sheet S1 to the discharge path, and the discharge rollers 4 discharge the sheet S1 onto the stack member D1 in the discharge space D as shown in FIG. 4E.

Figure 5B:
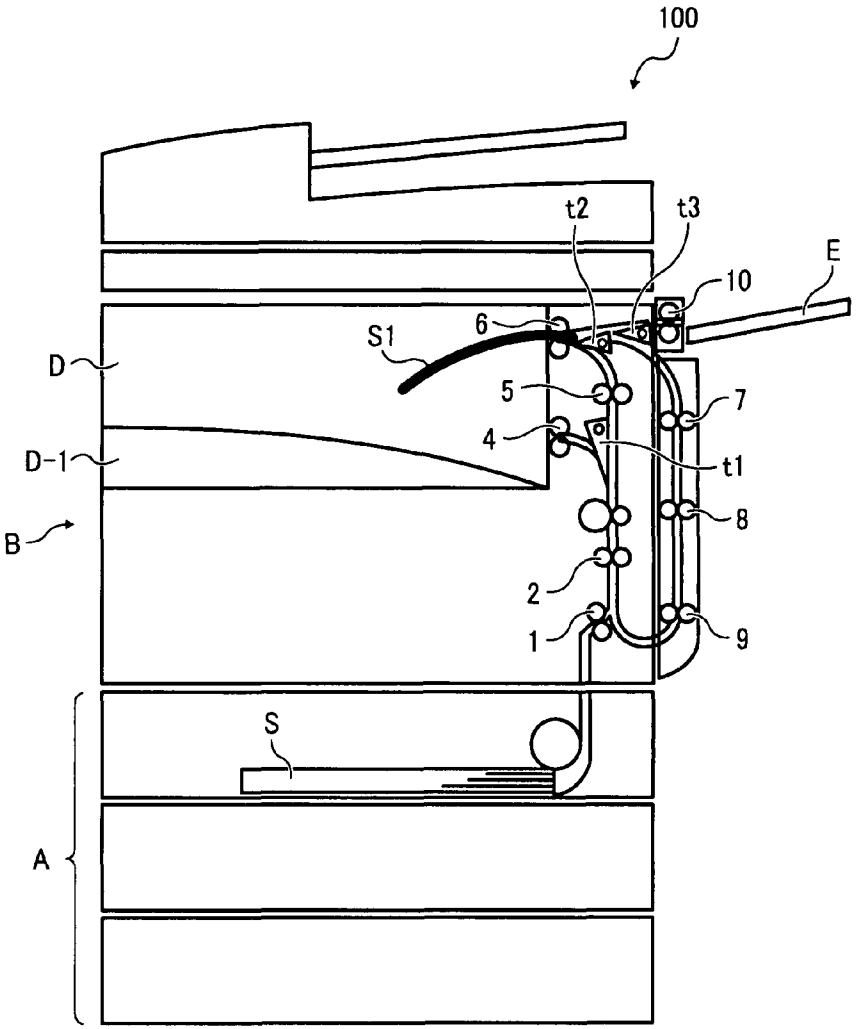
FIGS. 5A through 5C illustrate sheet transport in the image forming apparatus shown in FIG. 2 when sheets are discharged onto a side discharge unit.
Figure 5A:
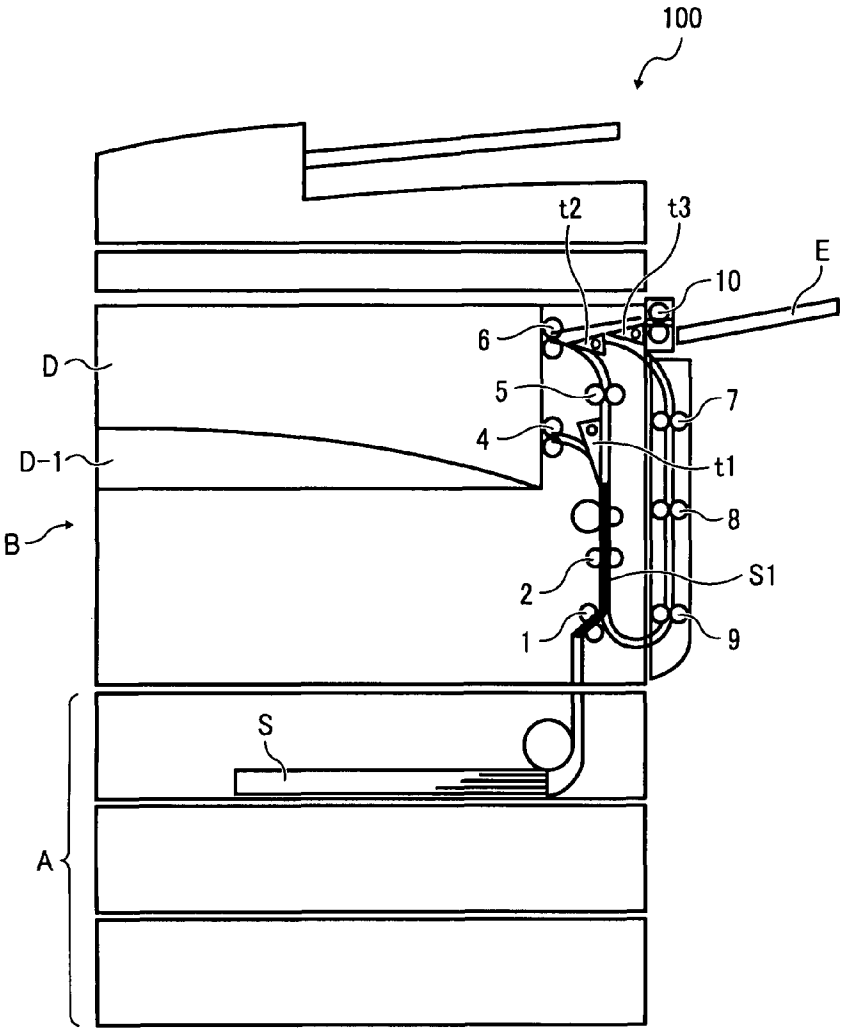
Figure 5D:
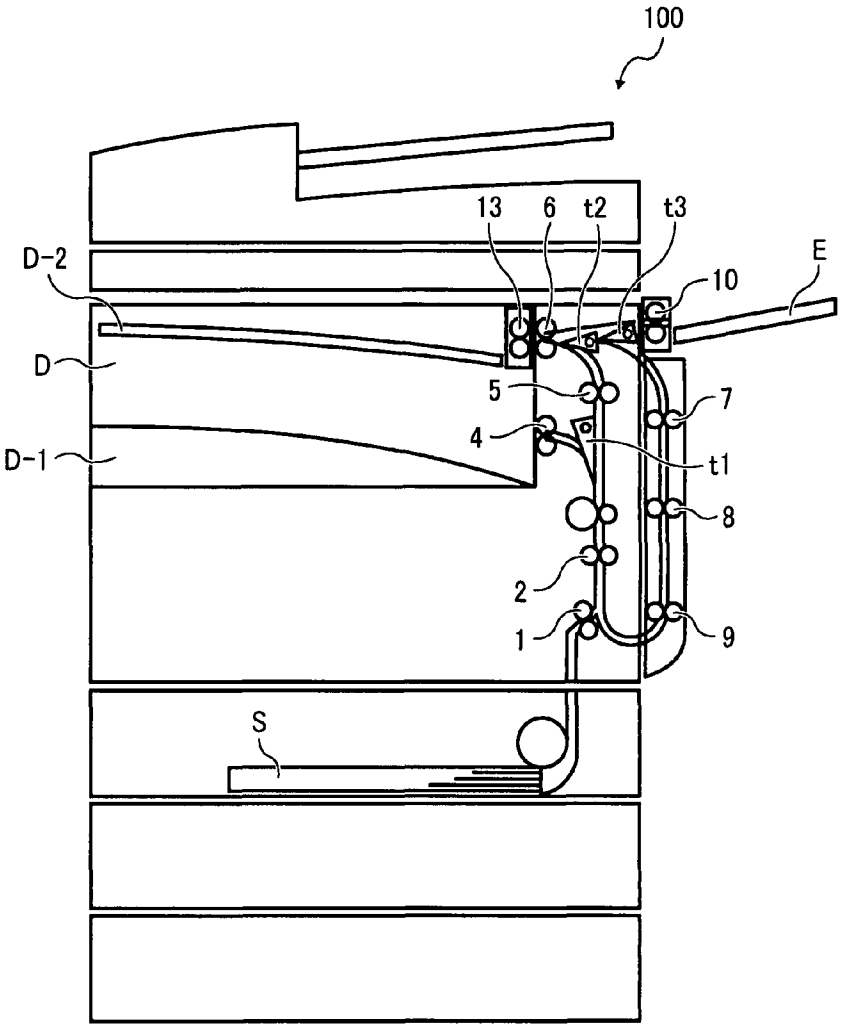
FIG. 5D illustrates a state of the image forming apparatus in which an additional discharge unit is mounted in a housing-internal discharge space.
Figure 5C:
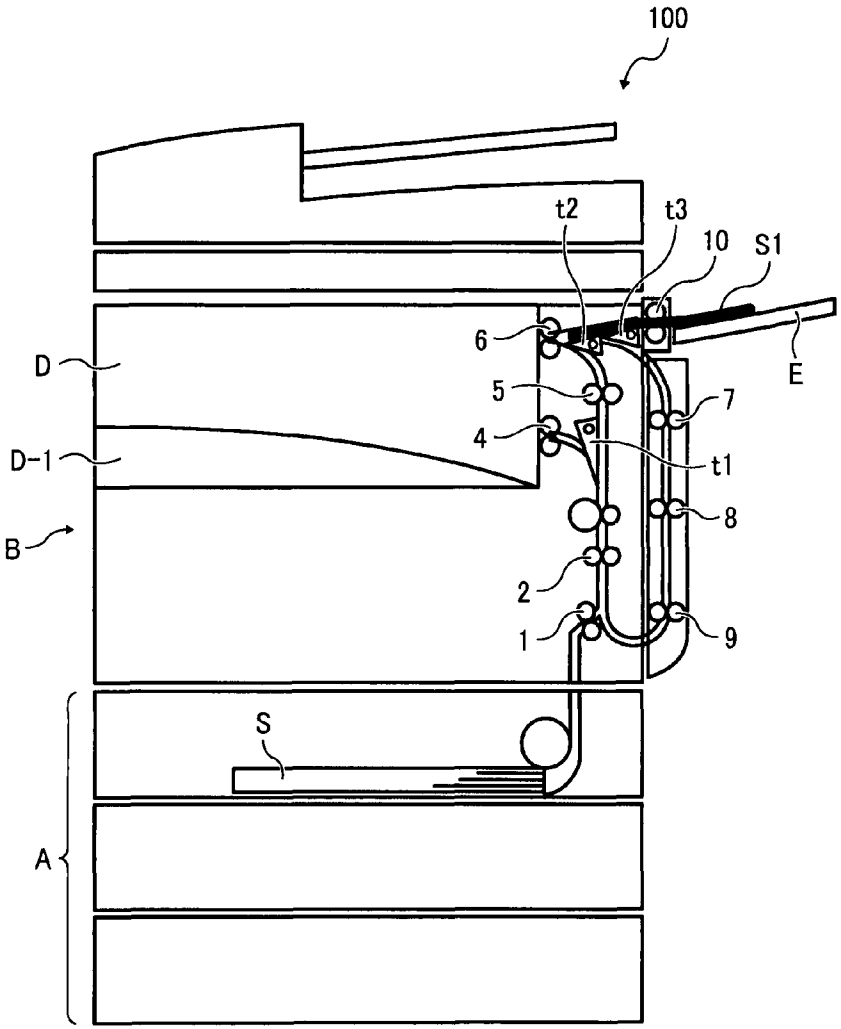

The image forming apparatus 100 further includes a detachably attachable discharge unit D-2, serving as an additional discharge unit, and a detachably attachable side discharge unit or right-side tray E. FIGS. 5A through 5C illustrates sheet transport when the side discharge unit E including a tray portion and a pair of discharge rollers 10 is attached to the right side of the image forming apparatus 100 in FIGS. 5A through 5C. FIG. 5D illustrates sheet transport when the discharge unit D-2 is attached to the image forming apparatus 100 in addition to the side discharge unit E.

Referring to FIG. 5A, when the side discharge unit E is attached to the main body B, the switching member t1 guides the sheet S1 to the transport path leading to the reverse rollers 6 after the image is formed on the sheet S1 fed from the sheet feeder A. Then, as shown in FIG. 5B, the transport roller pair 5 transports the sheet S1, and the switching member t2 guides the sheet S1 to the reverse path after the trailing edge of the sheet S1 passes the switching member t2.

Subsequently, the reverse rollers 6 rotate in reverse, thereby forwarding the sheet S1 to the right side path. After the sheet S1 passes the switching member t3, the discharge rollers 10 discharge the sheet S1 on the right-side tray E as shown in FIG. 5C. The sheets are discharged on the right-side tray E sequentially with their image surfaces faced down.

As shown in FIG. 5D, the discharge unit D-2 can be additionally attached to the main body B. This discharge unit D-2 may be attached to the main body B with a positioning member Bk shown in FIG. 11.

Referring to FIG. 5D, the discharge unit D-2 includes a pair of discharge rollers 13 and a stack portion, and is disposed downstream from the reverse rollers 6 in the sheet discharge direction. Thus, when the sheet S1 is reversed in the duplex printing mode or is to be discharged onto the right-side tray E, the stack portion of the discharge unit D-2 holds the exposed portion of the sheet S1 transported by the reverse rollers 6, and the pair of discharge rollers 13 rotate in an identical direction.

Moreover, by using the discharge unit D-2, the sheets can be separately discharged from the sheets discharged onto the stack member D-1 that is the standard discharge tray.

Next, a state in which an auxiliary unit, which is one of a relay unit and the finisher, is mounted in the discharge space D instead of the stack member D-1 is described below with reference to FIGS. 6A through 6D.

Figure 6B:
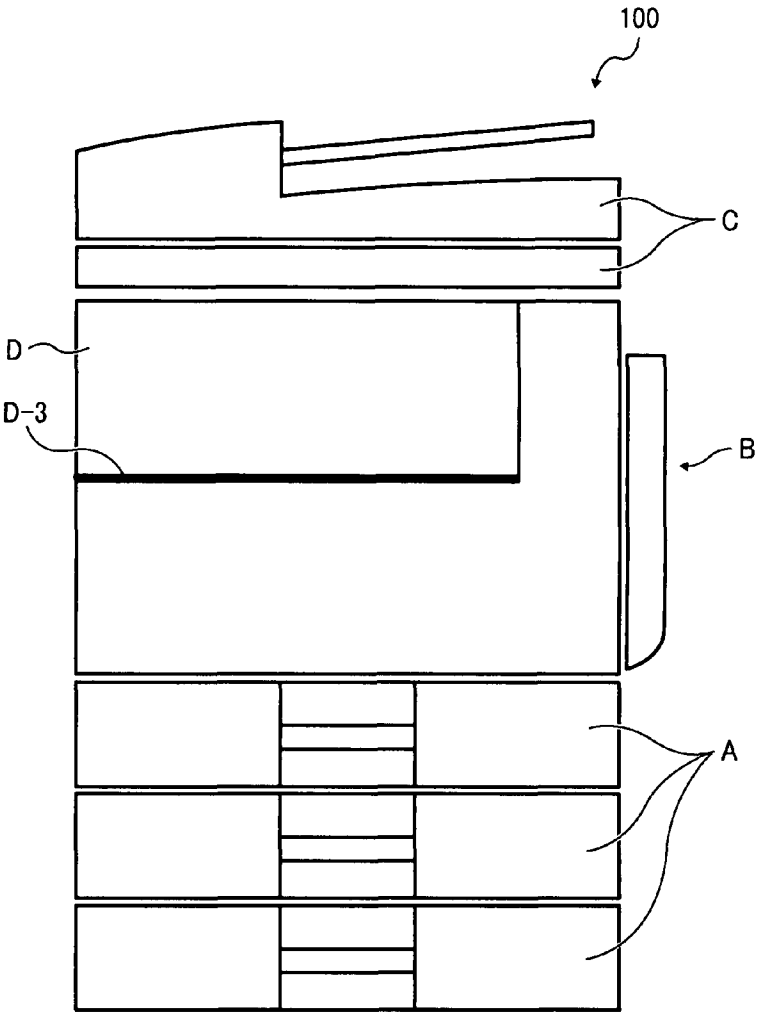
FIGS. 6A and 6B illustrates removal of a stack member from the discharge space.
Figure 6A:
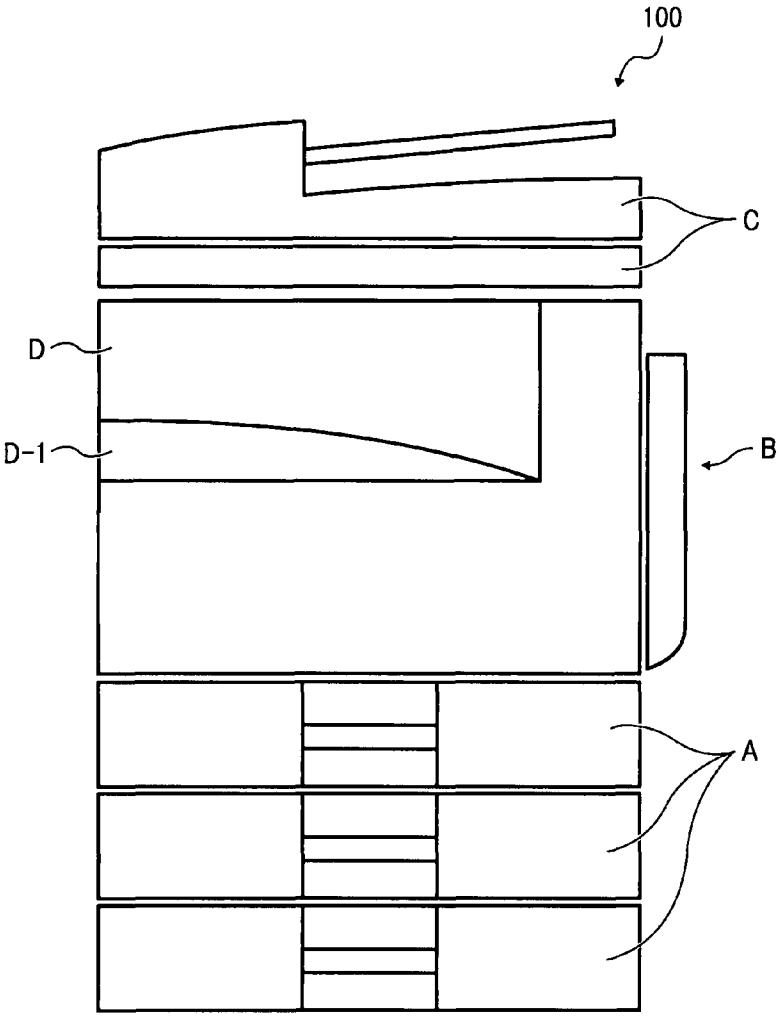
Figure 6D:
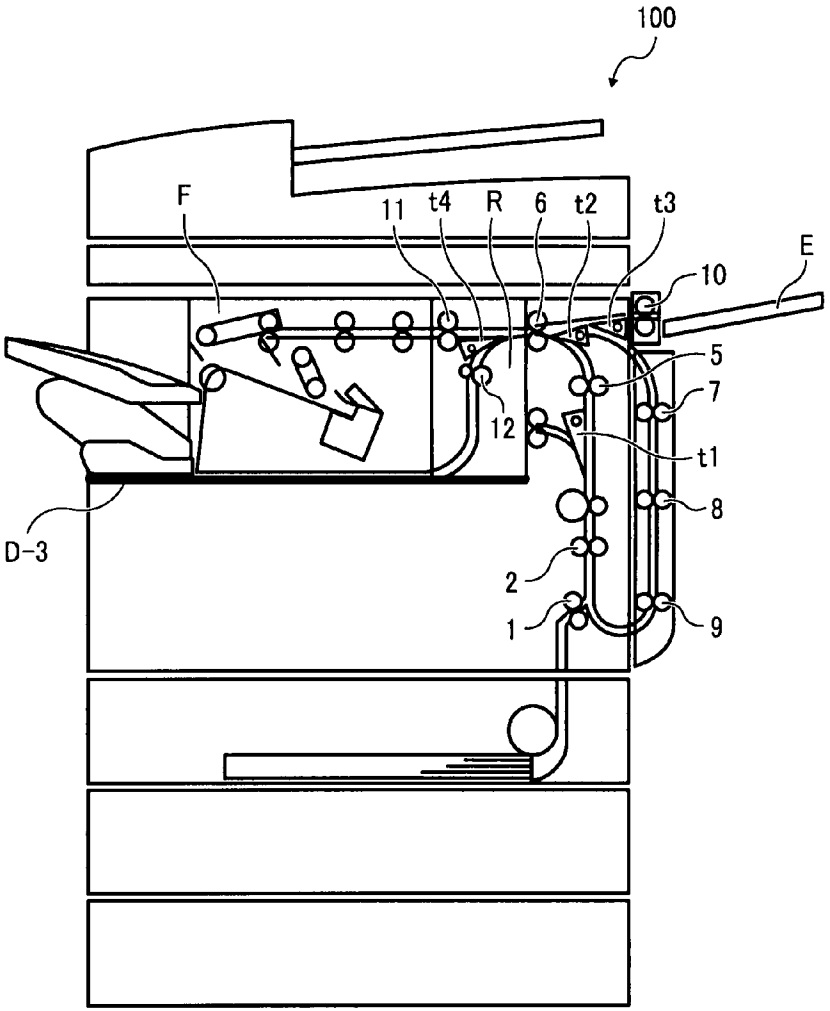
FIG. 6D illustrates a state of the image forming apparatus in which a stapler as well as the reverse unit are mounted in the discharge space.
Figure 6C:
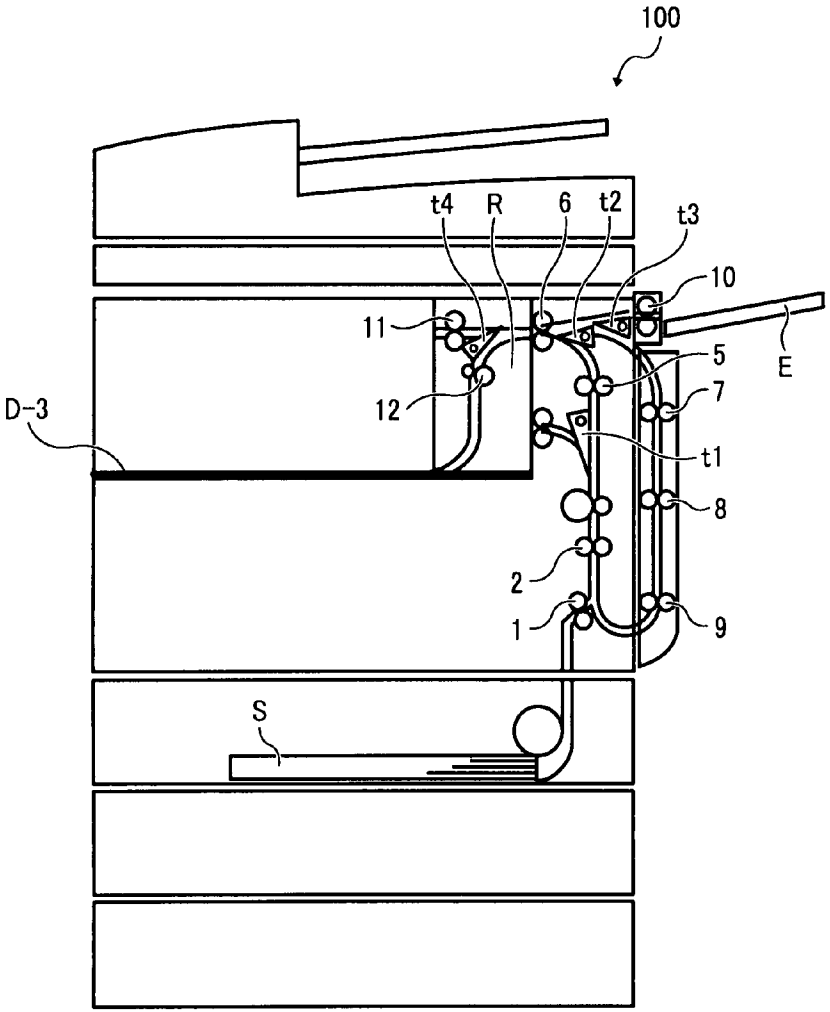
FIG. 6C illustrates a state of the image forming apparatus in which a reverse unit is mounted in the discharge space.

FIGS. 6A and 6B illustrate removal of the stack member D-1 from the discharge space D. FIG. 6C illustrates a state in which a reverse unit R is mounted in the discharge space D, and FIG. 6D illustrates a state in which the stapler F (finisher) as well as the reverse unit R are mounted in the discharge space D. The reverse unit R, serving as the relay unit, relays the sheet sent from the main body B downward to the finisher. In addition, the reverse unit R includes a reverse path to send back the sheet to the main body B in the duplex printing mode.

As described above, the stack member D1 can be removed from the discharge space D to increase the space of the discharge space D, and the stapler F cam be mounted in the discharge space D. In the present embodiment, because the stack member D-1 covers an interior of the image forming unit B, the interior of the image forming unit B is covered with a partition D-3 shown in FIG. 6B after the stack member D-1 is removed.

In the configuration shown in FIG. 6C, the stapler F serving as the finisher as well as the reverse unit R serving as the relay unit are mounted in the discharge space D. The reverse unit R receives and guides the sheet discharged by the reverse rollers 6 so that the reversal of the sheet is not blocked even when the finisher occupies the discharge space D. The stapler F is mounted downstream from the reverse unit R in the sheet discharge direction as shown in FIG. 6D. The reverse unit R serving as the auxiliary unit is attached to the main body B with the positioning member Bk, shown in FIG. 11, that includes positioning pins 504 and 505 serving as positioning portions disposed to cross the direction in which the sheets are transported (hereinafter "sheet transport direction"). The positioning member Bk sets the position of the auxiliary unit, that is, the finisher such as a stapler F (shown in FIG. 10) attached to the image forming apparatus 100 with the positioning pins 504 respectively engaging positioning holes H1 and H2 serving as recessed engagement portion.

Referring to FIG. 6C, the reverse unit R includes a sheet receiving port to receive the sheet from the main body B, a first transport path provided with a pair of rollers 11, a second transport path provided with a pair of rollers 12, and a switching member t4 to switch between the first transport path and the second transport path. The second transport path is used as the reverse path to send back the sheet from the reverse unit R to the main body B.

Referring to FIG. 6D, the stapler F includes known processing members such as a transport path, a transport member, an aligning member, a stapling member, and a stack member. The stapler F staples a bundle of sheets together. The finisher includes a stacker or the like in addition to the stapler F.

Figure 7B:
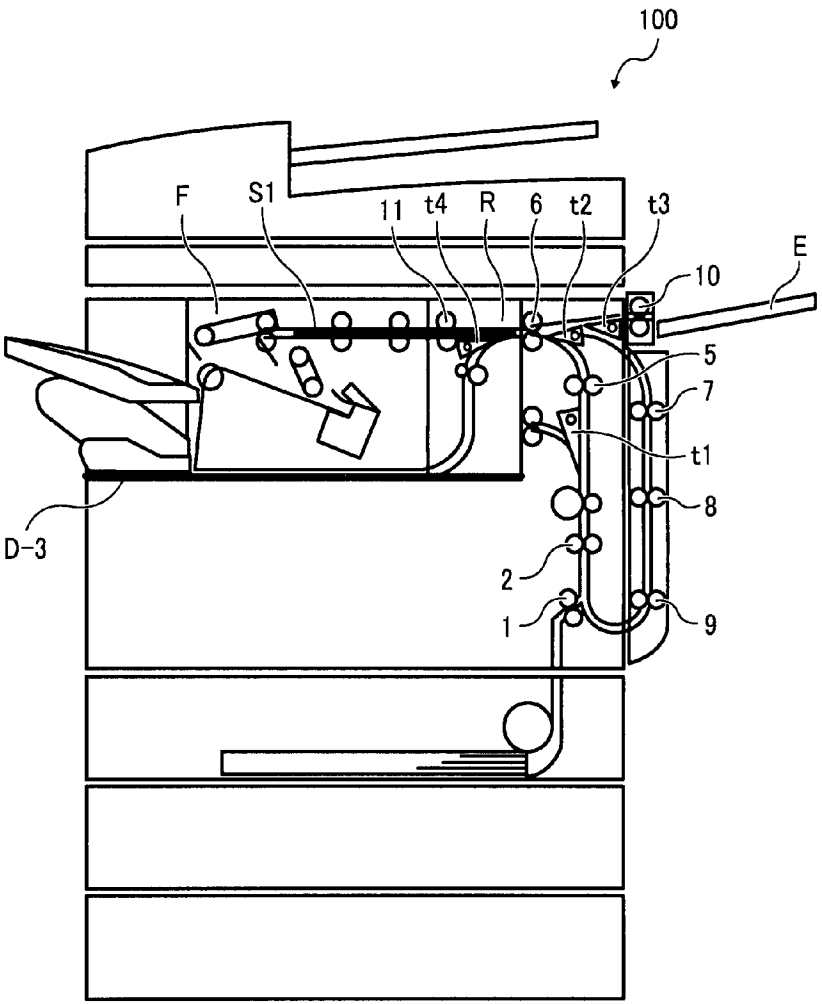
FIG. 7A through 7C illustrate sheet transport in the image forming apparatus shown in FIG. 6D operating in the single-side printing mode.
Figure 7A:
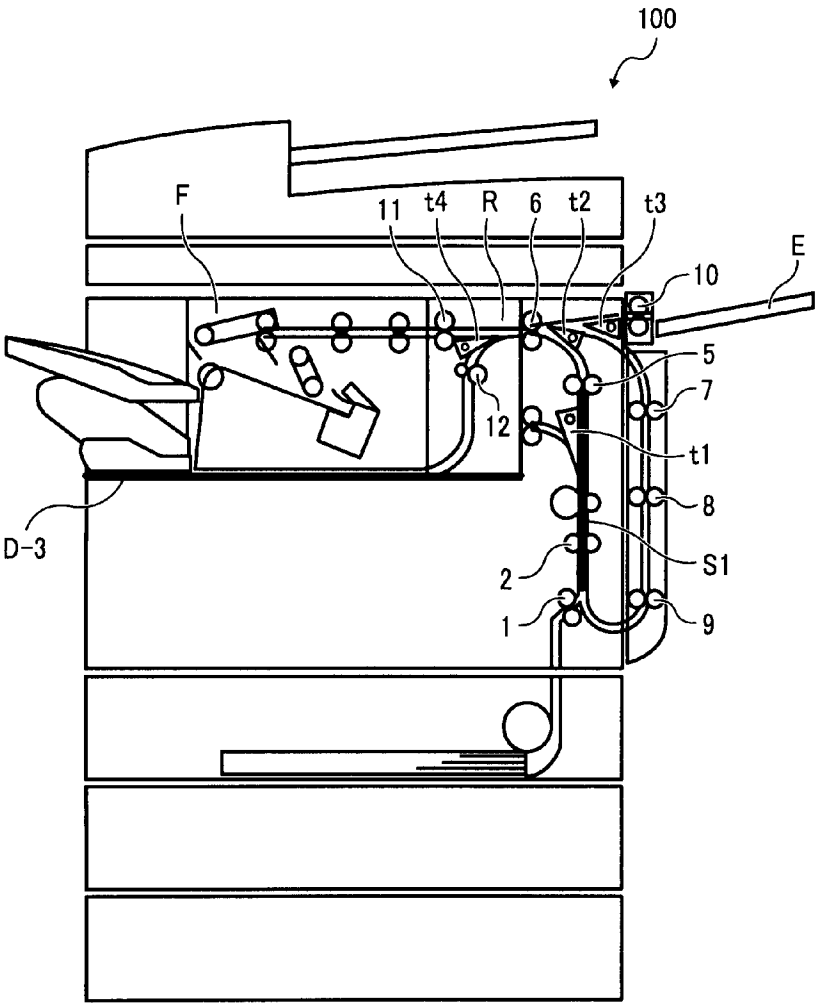
Figure 7C:
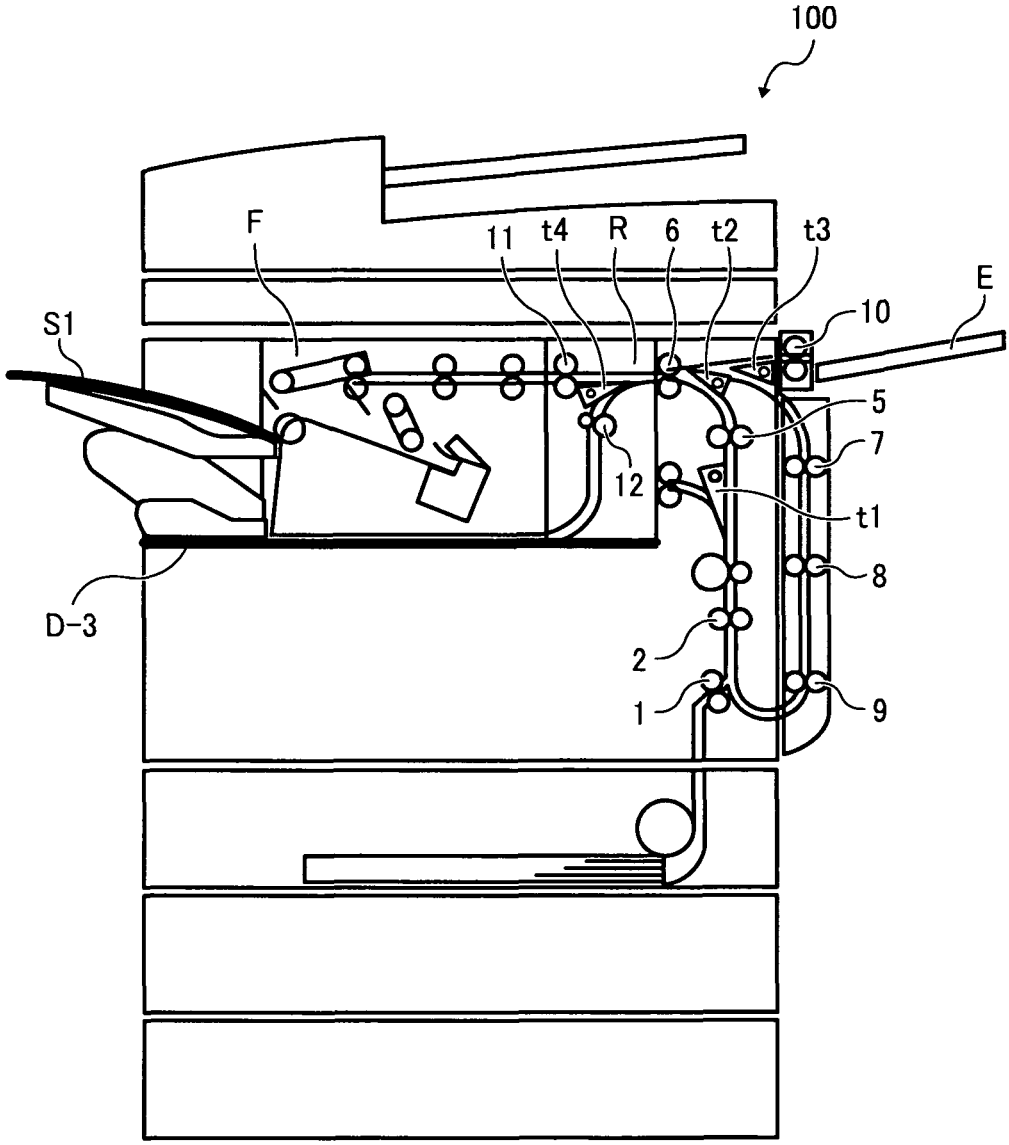

FIGS. 7A through 7C illustrate sheet transport when the image forming apparatus operates in the single-side printing mode and performs stapling.

As shown in FIG. 7A, after the image is formed thereon in the image forming unit B, the sheet S1 is guided by the switching members t1 to the transport path leading to the reverse rollers 6, transported by the transport roller pair 5, and then guided by the switching member t2 to the reverse rollers 6. The reverse rollers 6 rotate in the normal direction to forward the sheet S1 to the reverse unit R. In the reverse unit R, the switching member t4 guides the sheet S1 to the first transport path, and the rollers 11 transport the sheet S1 to the stapler F as shown in FIG. 7B. In the stapler F, a bundle of sheets are stapled and then discharged onto the stack member of the stapler F as shown in FIG. 7C.

FIGS. 8A through 8E illustrate sheet transport when the image forming apparatus operates in the duplex printing mode and performs stapling.

Figure 8B:
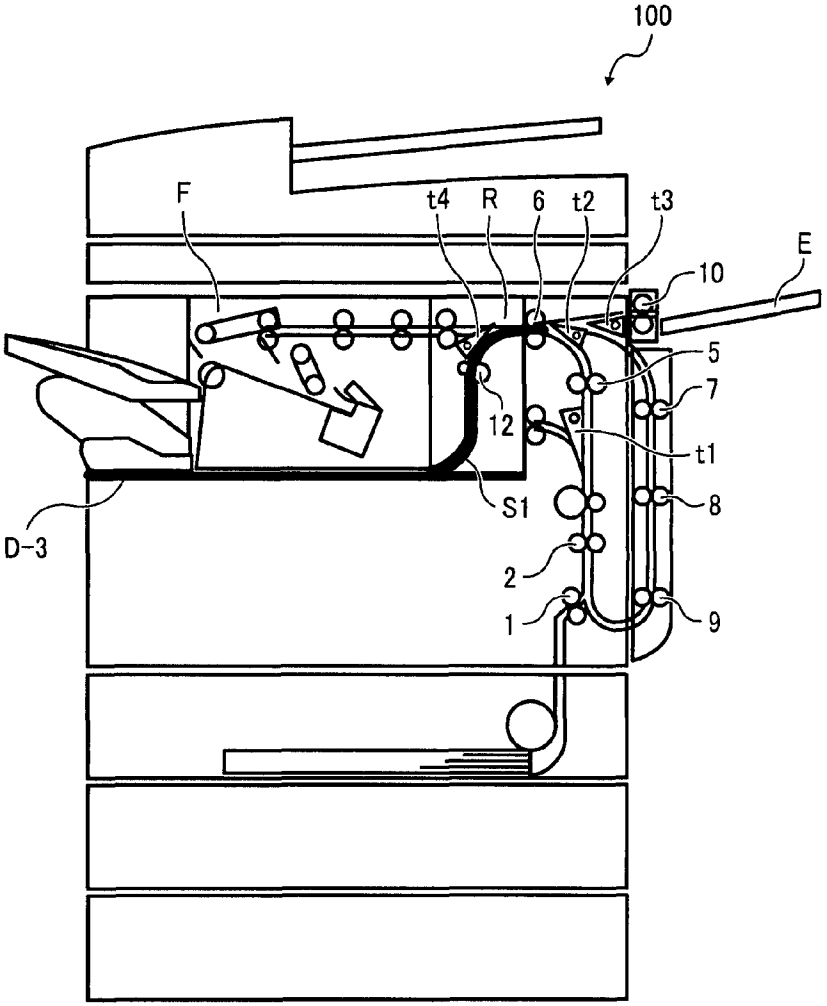
FIGS. 8A through 8E illustrate sheet transport when the image forming apparatus shown in FIG. 6D operates in the duplex printing mode.
Figure 8A:
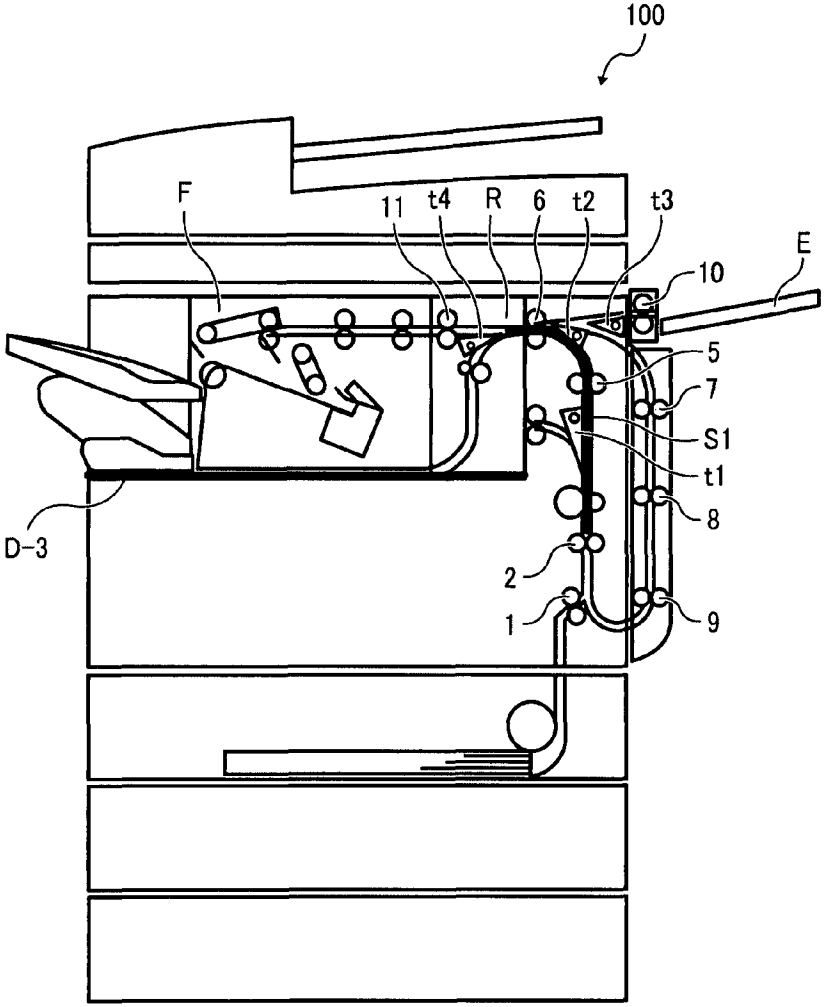

As shown in FIG. 8A, after the image is formed on the first side thereof in the image forming unit B, the sheet S1 is guided by the switching members t1 to the transport path leading to the reverse rollers 6, transported by the transport roller pair 5, and then guided by the switching member t2 to the reverse rollers 6. The reverse rollers 6 rotate in the normal direction, forwarding the sheet S1 to the reverse unit R.

Figure 8D:
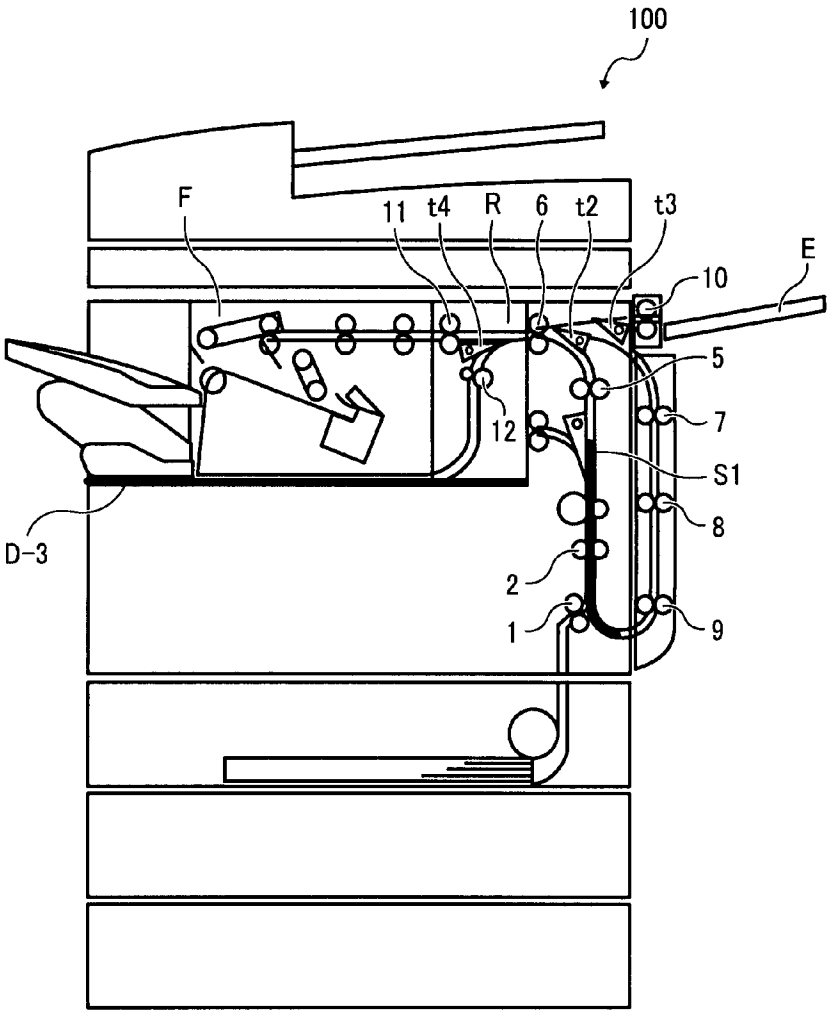
Figure 8C:
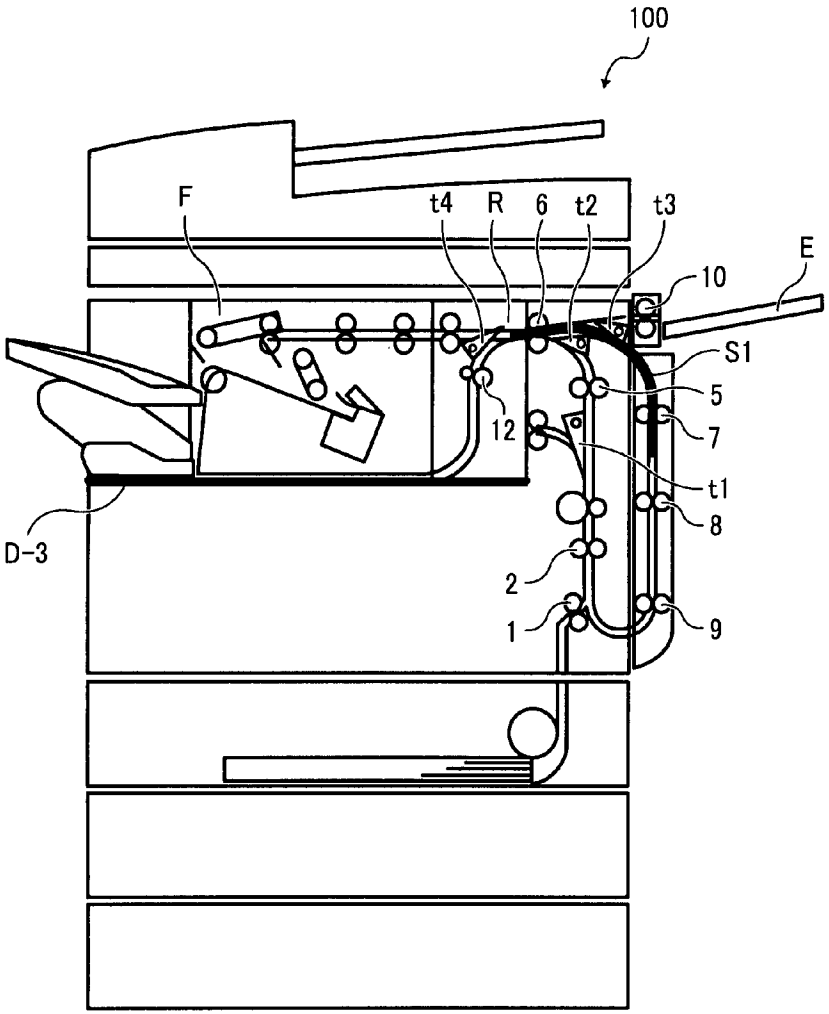

In the reverse unit R, as shown in FIG. 8B, the switching member t4 guides the sheet S1 to the second transport path (reverse path) provided with the rollers 12 not the first transport path leading to the stapler F. After the trailing edge of the sheet S1 passes the switching member t2, the switching member t2 switches the sheet transport path to the right side path of the reverse path, and the revere rollers 6 states reverse rotation to send back the sheet S1 to the reverse path of the main body B as shown in FIG. 8C. Subsequently, as shown in FIG. 8D, the reversed sheet S1 is again transported by the transport roller pair 2, and an image is formed on the second side of the sheet S1, which after the sheet S1 is transported to the reverse rollers 6. Then, the sheet 51 is transported to the reverse unit R, and the switching member t4 guides the sheet S1 to the first transport path. The sheet S1 is then transported to the stapler F as shown in FIG. 8E.

Next, a case in which the sheet is discharged onto the right-side tray E using the reverse unit R is described below.

Figure 8F:
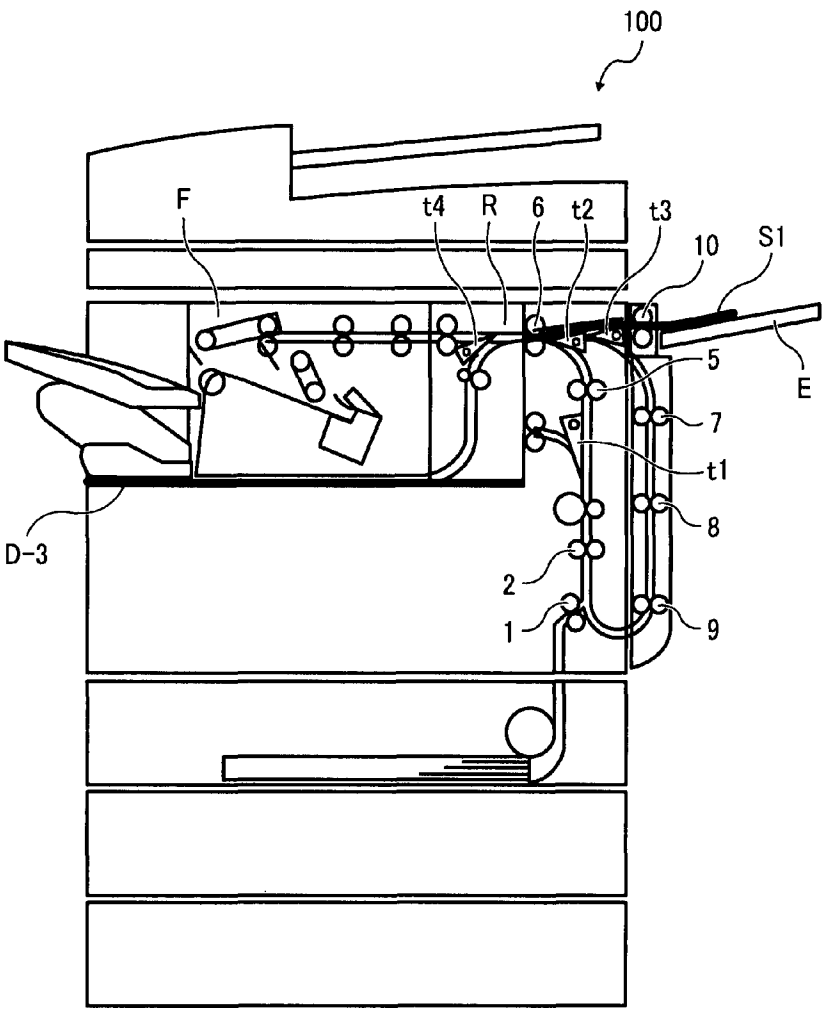
FIG. 8F illustrates a state in which the sheet reversed through the reverse unit is discharged onto the side discharge unit.
Figure 8E:
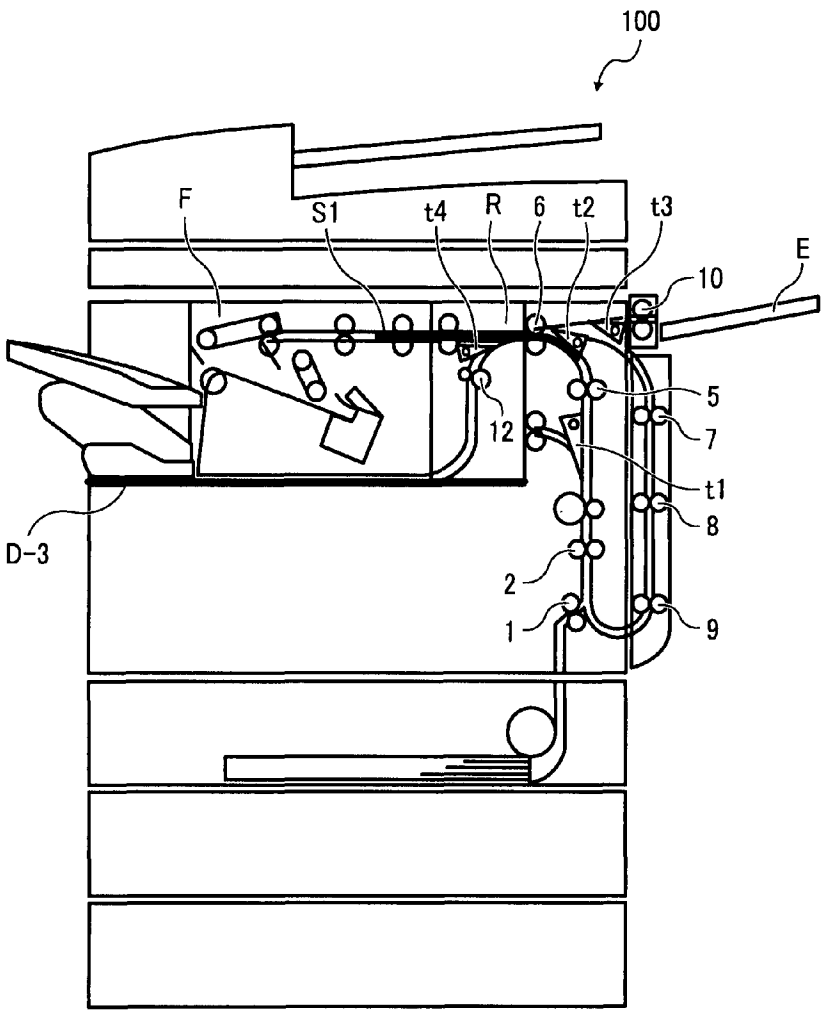

In this case, the sheet S1 moves in the image forming apparatus 100 as shown in FIGS. 8A, 8B, and 8F. Similarly to the sheet transport in duplex printing, after image formation, the sheet S1 passes the switching member t1, the transport roller pair 5, and the switching member t2 as shown in FIG. 8A, and then the reverse rollers 6 forward the sheet S1 to the second transport path (reverse path) in the reverse unit R as shown in FIG. 8B. After the trailing edge of the sheet S1 passes the switching member t2, the revere rollers 6 starts reverse rotation to send back the sheet S1. Then, the switching member t2 guides the sheet S1 to the right side path in the image forming unit B. Subsequently, the switching member t3 guides the sheet S1 to the discharge rollers 10 of the side discharge unit E, and then the discharge rollers 10 discharge the sheet S1 onto the side discharge unit E with its image side faced down as shown in FIG. 8F.

FIG. 9 illustrates a state of the image forming apparatus 100 when the stack member D-1 is removed from the discharge space D, and the side discharge unit E is Attached to the right side of the main body B.

Figure 10:
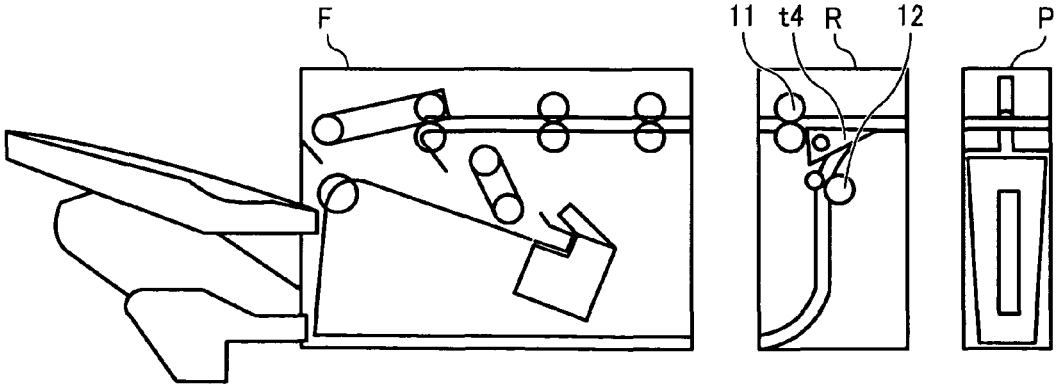
FIG. 10 schematically illustrates a configuration of the finisher.
Figure 11:
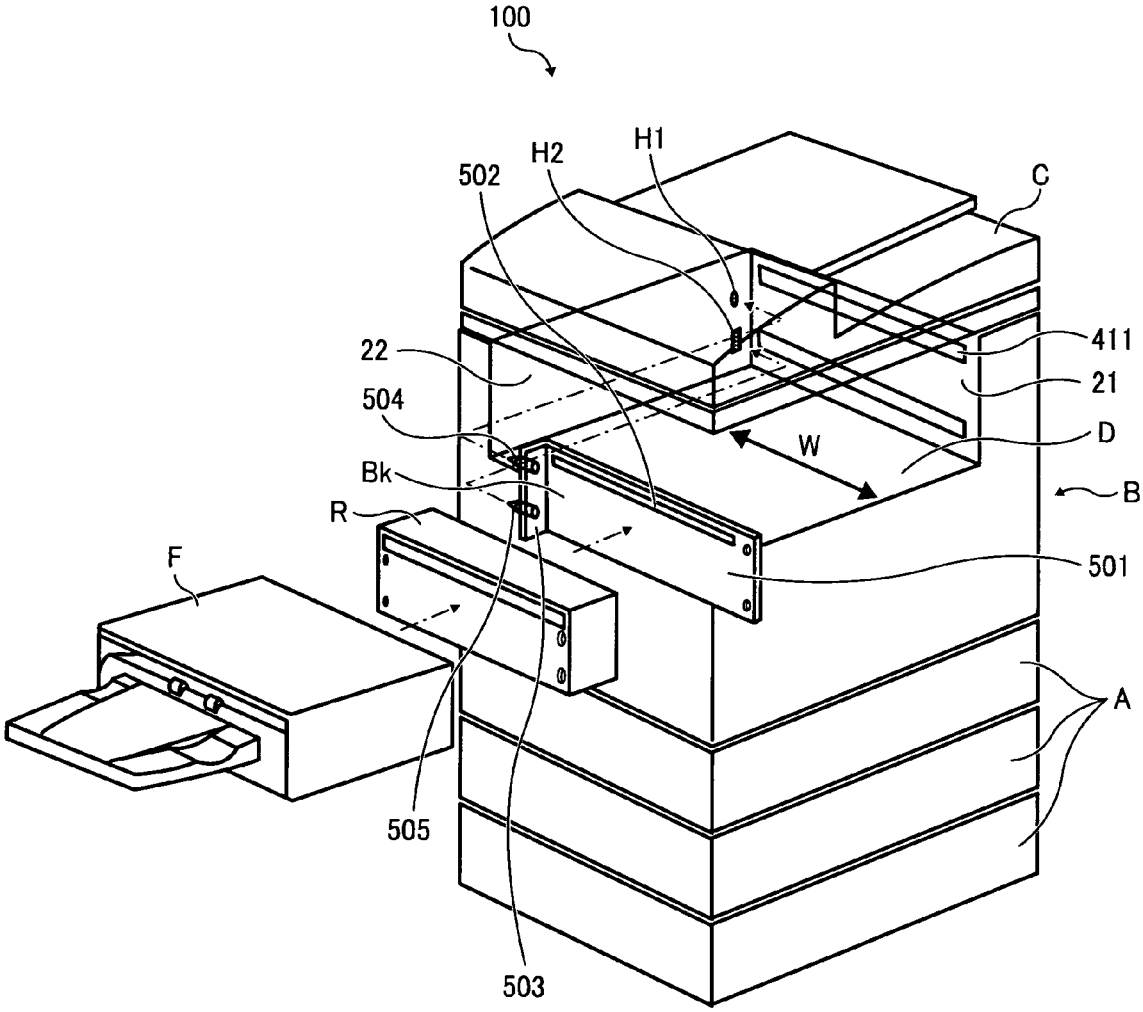
FIG. 11 is an exploded perspective view illustrating the image forming apparatus to which the reverse unit and the stapler are attached using a positioning member.
Figure 12:
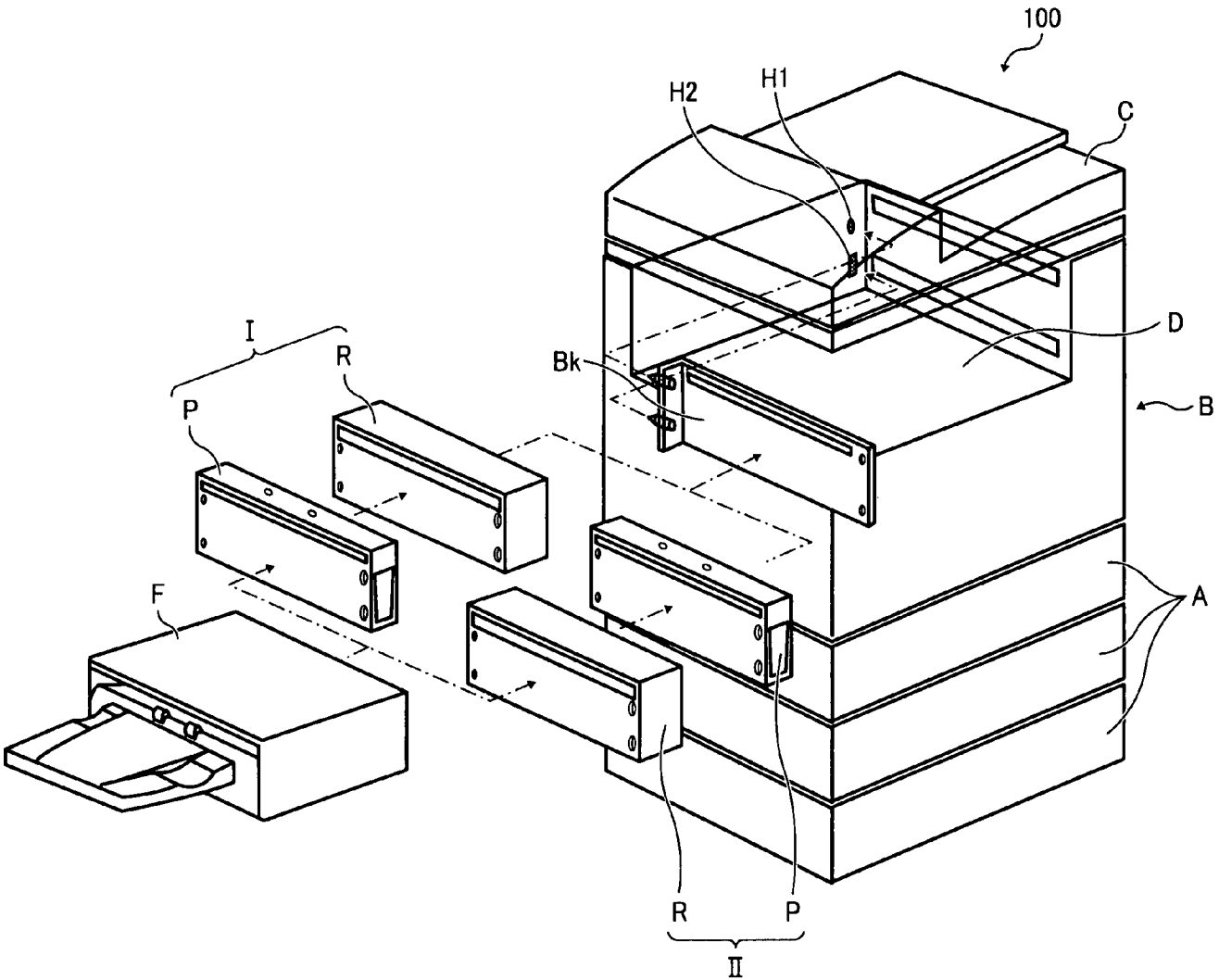
FIG. 12 is an exploded perspective view illustrating the image forming apparatus to which a punch is attached in addition to the reverse unit and the stapler.

Descriptions will be made below of the finisher to be attached to the image forming apparatus 100 with reference to FIGS. 10, 11, and 12. FIG. 10 schematically illustrates the finisher. FIG. 11 is an exploded perspective view illustrating the image forming apparatus to which the reverse unit and the stapler are attached. FIG. 12 is an exploded perspective view illustrating the image forming apparatus to which a punch is attached in addition to the reverse unit and the stapler.

In the present embodiment, users can select the finisher to be attached to the image forming apparatus 100 as required. More specifically, as the finisher, users can select either a combination of the stapler F and the reverse unit R, or a combination of the punch P, the stapler F, and the reverse unit R.

Attaching the combination of the stapler F and the reverse unit R to the image forming apparatus 100 is described below with reference to FIG. 11.

In this case, the stapler F and the positioning member Bk are attached to the reverse unit R, and the positioning member Bk is fixed to a first inner side wall 21 of the main body B defining the housing-internal discharge space D. The first inner side wall 21 of the main body B includes a discharge port 411 that connects to the sheet receiving port of the reverse unit R, and the positioning holes H1 and H2 that respectively engage the positioning pins 504 and 505 are formed in a second inner side wall 22 of the main body B perpendicular to the first inner side wall 21. The positioning holes H1 and H2 are formed adjacent to the discharge port 411.

To connect the sheet receiving port of the finisher and/or the relay unit R to the discharge port 411 properly in the sheet discharge direction as well as in a vertical direction, which is substantially perpendicular to the sheet discharge direction, the position of the relay unit R or the finisher should be set in a direction indicated by double-headed arrow W shown in FIG. 11, perpendicular to the sheet discharge direction along a horizontal plane. In addition, to mount the relay unit R or the finisher in the housing-internal discharge space D that is defined by the image reading unit C and the image forming unit B, that is, space thereof is limited, a simple and reliable configuration is necessary. Therefore, the positioning member Bk includes the positioning pins 504 and 505 extending in the direction indicated by double-headed arrow W perpendicular to the sheet discharge direction. In the present embodiment, by engaging the upper positioning pins 504 with the positioning hole H1 formed in the position adjacent to the discharge port 411, the finisher and/or the relay unit R can be positioned in the sheet discharge direction as well as in the vertical direction relative to the discharge port 411 in a relatively simple and reliable way.

The positioning member Bk includes a plate 501 in which an opening 502 is formed and a standing portion 503 standing on the plate 501 in the sheet discharge direction. The opening 502 is aligned with the discharge port 411 as well as the receiving port formed in the reverse unit R. Thus, the positioning member Bk is L-shaped with the plate 501 and the standing portion 503. The positioning pins 504 and 505 project from an outer side of the standing portion 503 toward the second inner side wall 22 of the main body B, that is, extend in the direction indicated by arrow W shown in FIG. 11, perpendicular to the sheet transport direction (sheet discharge direction), along the horizontal face. The standing portion 503 contacting the second inner side wall 22 of the main unit B can position the finisher and/or the relay unit R in the direction indicated by double-headed arrow W shown in FIG. 11.

By engaging the positioning pins 504 respectively with the positioning holes H1 and H2, the reverse unit R to which the positioning member Bk is attached can be positioned relatively to the image forming apparatus 100 so that the discharge port 411 properly connects to the receiving port of the reverse unit R via the opening 502 formed in the positioning member Bk.

Next, attaching the combination of the punch P, the stapler F, and the reverse unit R to the image forming apparatus 100 is described below with reference to FIG. 12.

In this case, as shown in FIG. 12, the reverse unit R and the punch P can be arranged in the sheet discharge direction either in that order as an arrangement I or arranged in reverse as an arrangement II. The stapler F is downstream from both the reverse unit R and the punch P. In the arrangement I, the reverse unit R is an extreme upstream unit to be attached to the positioning member Bk, and the punch P is a subsequent unit to be attached to the first unit (reverse unit R). In this state, the positioning pins 504 are engaged with the positing holes H1 and H2, respectively, which after the stapler F is fixed to the punch P. By contrast, in the arrangement I, the punch P is an extreme upstream unit and sandwiched between the positioning member Bk and the reverse unit R that is a subsequent unit, and, in this state, the positioning pins 504 are engaged with the positing holes H1 and H2, respectively, which after the stapler F is fixed to the reverse unit R.

The order in which the finisher units are attached to the image forming apparatus 100 can be flexibly determined not limited to the description above.

Figure 13A:
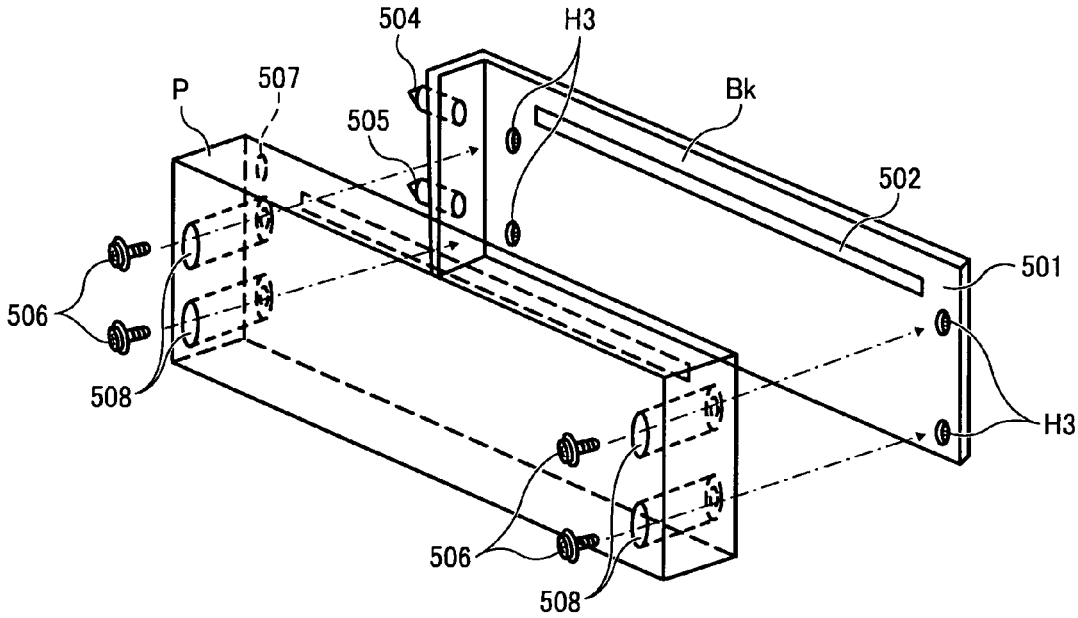
FIGS. 13A and 13B illustrate attaching the finisher to the positioning member.
Figure 13B:
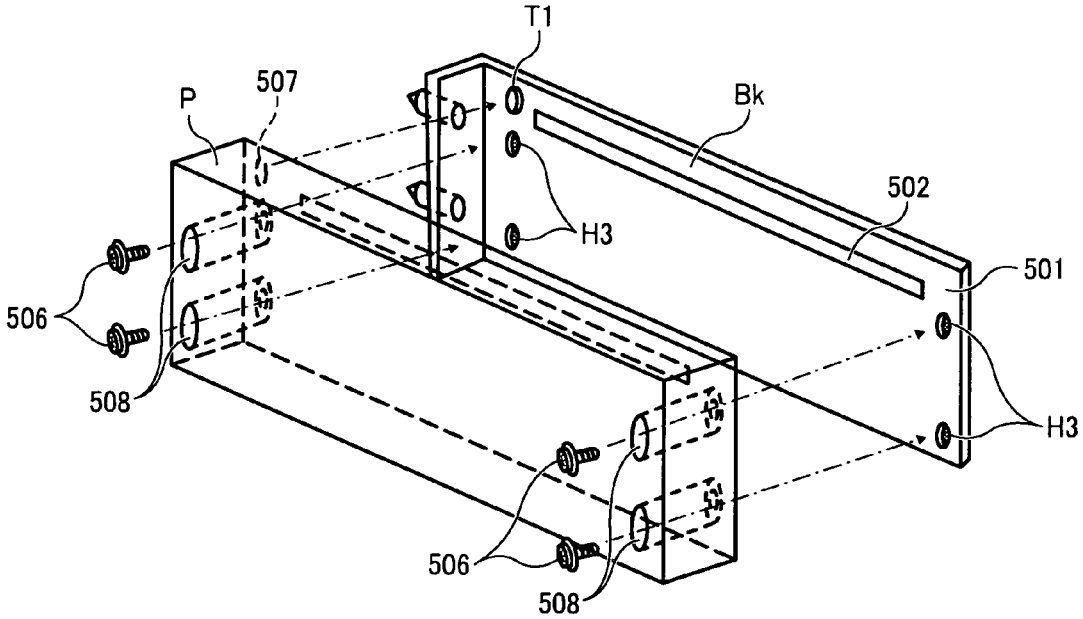

FIGS. 13A and 13B illustrate attaching the punch P as the finisher to the positioning member Bk.

In the present embodiment, the finisher, which in the configuration shown in FIGS. 13A and 13B is the punch P, is screwed to the positioning member Bk, and thus can be positioned relative to the positioning member Bk with screws engaging screw holes formed in the positioning member Bk.

More specifically, as shown in FIG. 13A, the punch P includes four screw holes 508 and the positioning member Bk includes four screw holes H3. The punch P is fixed to the positioning member Bk with four screws 506 each of which engages the screw hole 508 formed in the punch P as well as the screw hole H3 formed in the positioning member Bk. Another finisher unit can be similarly screwed to the punch P on the downstream side in the sheet discharge direction.

Alternatively, as shown in FIGS. 13A and 13B, the punch P can be positioned with a boss T1 formed on the positioning member Bk that engages with a recessed portion 507 formed in the punch P.

As described above, in the present embodiment, various combinations of the finisher units can be additionally attached to the image forming apparatus. In any of such combinations, the extreme upstream unit disposed extreme upstream among those units in the sheet discharge direction can be properly positioned to receive the sheets from the image forming apparatus, and the subsequent unit disposed downstream therefrom can be positioned relatively to the extreme upstream unit so that its receiving port is aligned with the discharge port of the extreme upstream unit from which the sheets are relayed. Thus, proper positioning of one of the units of the finisher and the relay unit relative to the discharge port of the image forming apparatus can be attained with a relatively simple mechanism, and the sheets can be relayed at proper positions from the upstream unit to the downstream unit in the sheet discharge direction.

Alternatively, as shown in FIG. 5D, the discharge unit D-2 (i.e., additional discharge unit) can be attached to the image forming apparatus with the positioning member Bk instead of the finisher or the reverse unit R (i.e., relay unit). Thus, in the present embodiment, the user can use the image forming apparatus in various styles by flexibly selecting the optional unit to be attached thereto among the stacking member D-1, the discharge unit D-2, the finisher (e.g., punch, stapler, or the like), the reverse unit R, and the side discharge unit E.

It is to be noted that because the positioning member Bk is disposed adjacent to the discharge port 411, heat generated in the image forming apparatus 100 can be transmitted through the discharge port 411 to the positioning member Bk and further to the finisher units. Because such heat can cause malfunction of the driving system and/or the transport system and can reduce durability of the components, the finisher units should be protected from the heat.

Therefore, in the present embodiment, the positioning member Bk includes a flat plate portion (e.g., plate 501) having a sufficient area to block hot air caused by the heat generated in the image forming apparatus, thus preventing the finisher units from directly contacting the hot air. The flat plate portion may be formed of metal, which has a higher thermal conductivity compared to other materials typically used for image forming apparatuses, such as rubber, resin, or glass. In this case, the flat plate portion having a relatively large area can receive the heat generated in the image forming apparatus, and then the heat can be dispersed in the housing of the image forming apparatus.

Next, an image forming apparatus according to another embodiment of the present invention is described below with reference to FIG. 14 that is an exploded perspective view illustrating an image forming apparatus 600.

Figure 14:
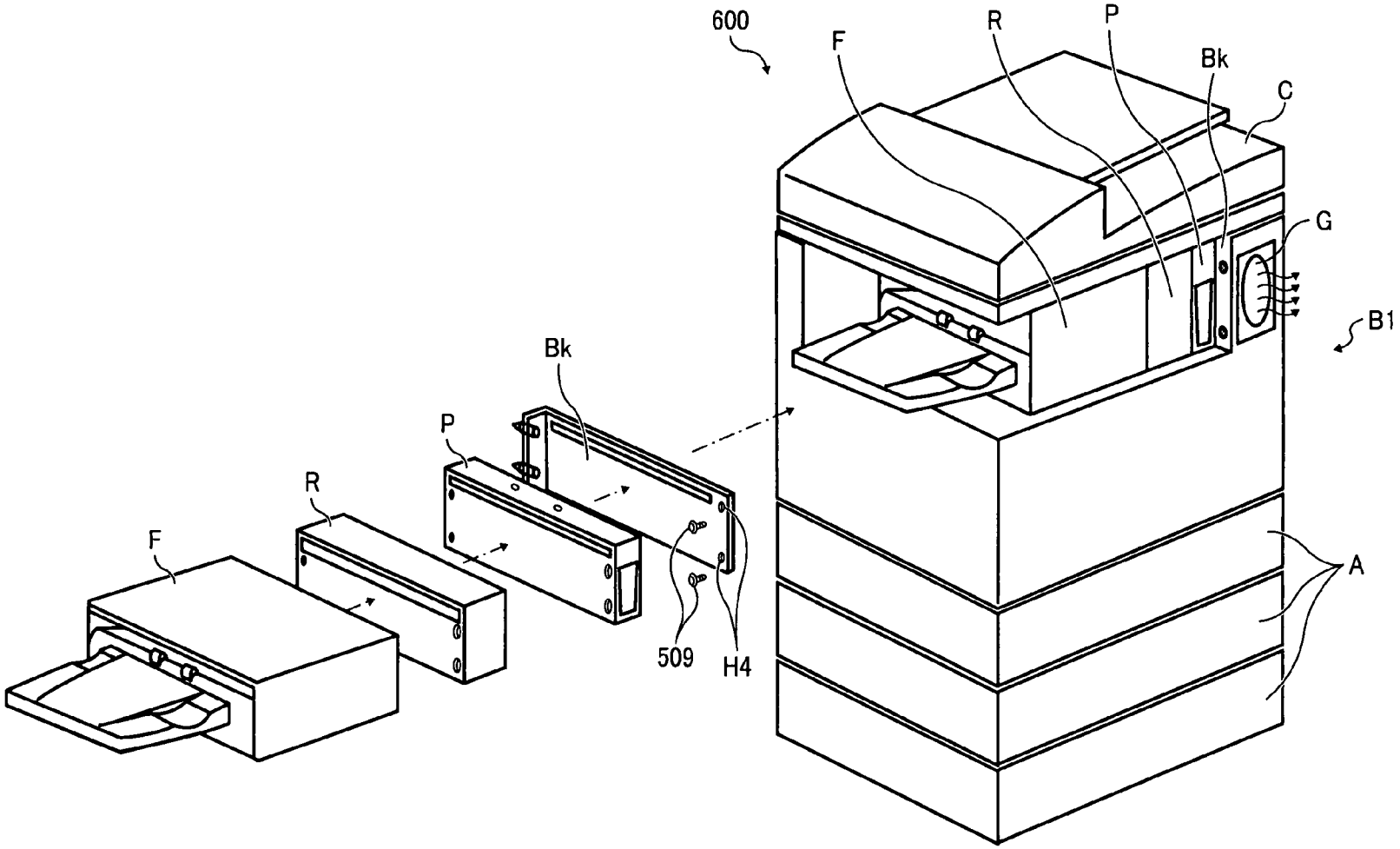
FIG. 14 is an exploded perspective view illustrating an image forming apparatus according to another illustrative embodiment.

Referring to FIG. 14, the punch P, the reverse unit R, and the stapler. F are attached to a main body B1 as the finisher units with the positioning member Bk similarly to the embodiment shown in FIG. 12. In addition, in the present embodiment, the main body B1 includes a cooling device G, such as a fan, a heat release plate, or the like, disposed adjacent to the position where the positioning member Bk is attached, to release heat generated in the image forming apparatus 600 externally. The cooling device G is disposed to direct the airflow generated by the released heat in a direction not to contact the finisher directly. In the present embodiment, even when the temperature inside the image forming apparatus 600 increases, the heat can be released outside efficiently, thus preventing or reducing an increase in the temperature of the finisher and/or the relay unit.

Alternatively, the a cooling device G may be configured to cool the positioning member Bk that receives the heat from the image forming apparatus 100. When the flat plate portion of the positioning member Bk is formed of copper, aluminum, or the like, which has a higher thermal conductivity compared to that of other metals, the heat of the positioning member Bk can be efficiently released by the cooling device G.

In addition, as shown in FIG. 14, the positioning member Bk can be positioned to the main body B1 with screws 509 engaging screw holes H4, respectively. The screws 509 further engage holes formed in an inner side wall of the main body B1.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image forming unit to form an image on a sheet of recording media;

an image reading unit to read image data of an original document, disposed above the image forming unit;

a sheet discharge space defined by multiple inner walls of a main body of the image forming apparatus including a first inner side wall and a second inner side wall, the sheet discharge space disposed between the image reading unit and the image forming unit;

a discharge port located on the first inner side wall of the main body of the image forming apparatus, the discharge port being a slot having a width at least equal to a width of the sheet of recording media discharged into the sheet discharge space through the discharge port; and a positioning member configured to position and detachably mount one of a plurality of auxiliary units adjacent to the discharge port in the sheet discharge space defined by multiple inner walls of the main body, the positioning member including, a plate having first and second surfaces and a pass-through port therebetween, the pass-through port being a slot having a width at least equal to the width of the sheet of recording media, the first surface including an engagement part configured to removably engage the one of the plurality of auxiliary units as an engaged auxiliary unit, the plurality of auxiliary units each having a receiving port, the receiving ports each being a slot having a width at least equal to the width of the sheet of recording media, and a positioning portion mountable in the sheet discharge space to the second inner side wall of the main body such that the second surface of the plate overlaps with the first inner side wall of the main body to align the pass-through port on the second surface with the discharge port and to align the pass-through port on the first surface with the receiving port of the engaged auxiliary unit such that the sheet of recording media can pass from the discharge port to the receiving port through the pass-through port to provide the sheet discharged through the discharge port to the engaged auxiliary unit.

2. The image forming apparatus according to claim 1, wherein the plurality of auxiliary units comprises a finisher unit and a relay unit.

3. The image forming apparatus according to claim 2, wherein the relay unit comprises a first transport path to transport the sheet downstream in a direction in which the sheet is discharged and a second transport path to receive a sheet to be reversed.

4. The image forming apparatus according to claim 1, wherein the positioning member is attachable to the plurality of auxiliary units to position one of the plurality of auxiliary units adjacent to the discharge port and to couple one of the plurality of auxiliary units to the main body of the image forming apparatus.

5. The image forming apparatus according to claim 1, wherein the positioning portion of the positioning member extends in a direction perpendicular to a direction in which the sheet is discharged, the main body of the image forming apparatus comprises a recessed engagement portion, and one of the plurality of auxiliary units are positioned in the direction in which the sheet is discharged and in a vertical direction with the positioning portion engaging the recessed engagement portion provided in the main body.

6. The image forming apparatus according to claim 5, wherein the recessed engagement portion is formed in the second inner side wall of the main body perpendicular to the first inner side wall in which the discharge port is located.

7. The image forming apparatus according to claim 6, wherein the positioning portion projects from the second surface of the plate, and the positioning portion contacts the second inner side wall of the main body when the positioning member is attached to the main body, and is configured to detachably attach to one of the plurality of auxiliary units.

8. The image forming apparatus according to claim 2, wherein the finisher unit comprises a punch.

9. The image forming apparatus according to claim 2, wherein the finisher unit comprises a stapler.

10. The image forming apparatus according to claim 1, wherein the plate extends in a direction perpendicular to a direction in which the sheet is discharged along the discharge port to block hot air exhaust from the image forming unit when attached to the image forming apparatus.

11. The image forming apparatus according to claim 10, wherein the pass-through port is configured to connect the discharge port located on the main body with the receiving port of the engaged auxiliary unit.

12. The image forming apparatus according to claim 10, wherein the plate is formed of a metal.

13. The image forming apparatus according to claim 1, further comprising:

a cooling device disposed adjacent to the auxiliary unit coupled to the image forming apparatus to cool the engaged auxiliary unit.

14. The image forming apparatus according to claim 6, wherein when the positioning portion engages the recessed engagement portion of the main body, the positioning member is supported entirely by support elements affixed to the first and second inner side walls.

15. The image forming apparatus according to claim 1, wherein the plate extends in parallel to the first inner side wall of the main body, is located in the sheet discharge space and is perpendicular to a direction in which the sheet is discharged, if the positioning portion is mounted to the second inner side wall in the sheet discharge space.

16. The image forming apparatus according to claim 1, wherein the plate directly contacts the first inner side wall when the positioning portion is mounted to the second inner side wall in the sheet discharge space.

* * * * *